US005950531A

United States Patent [19]

Uchiyama

[11] Patent Number: 5,950,531

[45] Date of Patent: Sep. 14, 1999

[54] ELECTRIC PRESS MACHINE

[75] Inventor: Shigeyuki Uchiyama, Nagano, Japan

[73] Assignee: Apic Yamada Corporation, Nagano, Japan

[21] Appl. No.: 09/084,600

[22] Filed: May 27, 1998

[30] Foreign Application Priority Data

May 28, 1997 [JP] Japan ..... 9-138561
Jul. 3, 1997 [JP] Japan ..... 9-178457

[51] Int. Cl.[6] ..... B30B 15/30; B30B 1/06

[52] U.S. Cl. ..... 100/53; 72/405.16; 72/450; 72/452.5; 100/207; 100/282

[58] Field of Search ..... 100/53, 207, 208, 100/215, 281, 282, 283; 72/405.09, 405.11, 405.16, 450, 452.5

[56] References Cited

U.S. PATENT DOCUMENTS 3,766,771 10/1973 Spachner et al. ..... 100/282

5,666,850 9/1997 Yanagisawa et al. ..... 72/452.5

*Primary Examiner*—Stephen F. Gerrity

*Attorney, Agent, or Firm*—Sughrue, Mion, Zinn, Macpeak & Seas, PLLC

[57] ABSTRACT

In a feeding mechanism 4 which reciprocates the feed arm 80 in a direction of transporting a lead frame, a movable body is linked via a second fulcrum 37 (movable fulcrum) with a rocking arm 30 which is pressingly contacted with a feed cam 11 and which rocks about a first fulcrum 31 (stationary fulcrum), rocking movement of the rocking arm 30 is converted into linear movement of the movable body which is directly coupled to reciprocal movement of the feed arm 80, and the distance between the first fulcrum 31 of the rocking arm 30 and the second fulcrum 37 is changed in the longitudinal direction of the rocking arm 30, thereby enabling a feed stroke of the feed arm 80 to be linearly changed.

13 Claims, 18 Drawing Sheets

ELECTRIC PRESS MACHINE

BACKGROUND OF THE INVENTION

1. Field of the Invention

The invention relates to an electric press machine which conducts press working on a lead frame in which pilot holes are formed while the lead frame is pitch fed to a press section having a press die. Also, the invention relates to a motor-operated press machine, and more particularly to a motor-operated press machine in which a press working operation with an ordinary stroke, and a die opening operation in, for example, replacement of a working die are enabled.

2. Description of the Related Art

A semiconductor device of the resin mold type is subjected to working such as dambar cutting and lead forming after resin mold working. These working operations are conducted by a press machine having a press die.

Usually, such a press machine is configured so that upper and lower dies are positioned between a punch holder which holds a punch, and a die holder which holds a die, and then set in the press machine, and press working is conducted while the upper die which is hydraulically or electrically vertically moved is guided by a guide post which is erected between the upper and lower dies.

As a mechanism for feeding a lead frame in such a press machine, the assignee of the present application has developed a machine disclosed in Japanese Patent Unexamined Publication No. HEI 6-77376. This feeding mechanism will be described. Referring to FIG. 1, at a press position, both the sides of a lead frame 101 are supported on feed plates 103*a* and 103*b* which are disposed above a die 102, respectively. The feed plates 103*a* and 103*b* are coupled to coupling members 104*a* and 104*b*. The feed plates 103*a* and 103*b* can be vertically moved by a vertically moving mechanism which will be described later. When the feed plates 103*a* and 103*b* are pressed down, the lead frame 101 is engaged with pilot pins 117 disposed on a die block 116, so as to be positioned. The reference numeral 118 designates a failure detecting pin which detects whether the lead frame is set at a predetermined position or not.

Feed pins 106*a* and 106*b* hang from the lead frame 101. The feed pins are caused to engage with pilot holes 101*a* of the lead frame 101 from the upper side, by feed arms 105*a* and 105*b* shown in FIG. 2. The feed arms 105*a* and 105*b* are reciprocated in the lateral directions in FIG. 2 by a reciprocating mechanism which is reciprocated by, for example, cylinder driving (an air cylinder).

The feed plates 103*a* and 103*b* are upward urgingly supported on rods 108*a* and 108*b* which are urged by coil springs 107*a* and 107*a* disposed on a pedestal section 107 shown in FIG. 3. The coupling members 104*a* and 104*b* are engaged with engaging members 109*a* and 109*b*. Lower ends of rods 110 and 110 respectively hanging from the engaging members 109*a* and 109*b* are linked in a vertically movable manner with rocking pieces 112*a* and 112*a* fixed to a rotation shaft 111. A rocking piece 112*b* is fixed to the rotation shaft 111. The cylinder rod of a cylinder 113 is coupled to the rocking piece 112*b*. When the cylinder 113 is operated, the rotation shaft 111 is rotated, so that the feed plates 103*a* and 103*b* are lowered against the urging force of the coil springs 107*a*, via the rocking pieces 112*a* and 112*a*, the rods 110 and 110, and the engaging members 109*a* and 109*b*.

In the press machine, when a feed cylinder which is not shown is operated and the lead frame 101 is fed by one pitch by means of the feed arms 105*a* and 105*b*, the cylinder 113 is operated to lower the feed plates 103*a* and 103*b*, thereby causing the feed pins 106*a* and 106*b* to disengage from the pilot holes 101*a* of the lead frame 101. Then, an electric motor or a hydraulic mechanism is operated so that an upper die section 114 is downward moved to a position where a stripper plate 115 presses down the feed plates 103*a* and 103*b*, thereby conducting press working. When the press working is ended, during a period when the upper die section 114 is upward moved, the feed arms 105*a* and 105*b* are moved to a position corresponding to the die 102, and wait there. The cylinder 113 is operated to upward move the feed plates 103*a* and 103*b*, thereby causing the feed pins 106*a* and 106*b* to engage with the pilot holes 101*a* of the lead frame 101 which is upward moved with being supported by the feed plates 103*a* and 103*b*. Then, the feed arms 105*a* and 105*b* are moved so as to feed the lead frame 101 by one pitch, and the above-mentioned press working is repeatedly conducted.

In the above-described press machine, the three kinds of operations, i.e., the vertical movement of the upper die section 114 by means of the electric motor or the hydraulic mechanism, the feeding operation of the feed arms 105*a* and 105*b* by means of cylinder driving, and the vertical movement of the feed plates 103*a* and 103*b* by means of the cylinder 113 are performed while they are synchronized with one other by electrical means. Therefore, press working of one cycle requires a prolonged time period (about 70 spm at the maximum), and it is difficult to shorten the cycle time (index time).

This is applicable also to a press machine in which the vertical movement of the upper die section 114 by means of hydraulic driving is employed. Since the number of parts is large, moreover, the production cost is high and the machine is bulky.

Since the feed arms 105*a* and 105*b* are fed by means of cylinder driving, the feeding is conducted at a constant speed. Therefore, a shock is applied to the lead frame 101 at the start of and before the stop of the feeding operation of the lead frame, and hence the lead frame is easily damaged. Furthermore, also the feed pins 106*a* and 106*b* are easily damaged.

The pitch of the pilot holes 101*a* of the lead frame 101 is varied depending on the kinds of the lead frame, and hence the stroke of the feeding to the press section must be adjusted. In the adjustment, the length of a stopper bolt or the like which regulates the range of the movement of the feed arms 105*a* and 105*b* due to cylinder driving must be adjusted. In order to adjust the feeding amount, it is necessary to stop press working, and hence the work efficiency is lowered.

When a lead frame is erroneously set, the operation of the press machine must be stopped, and the driving mechanisms for the upper die section 114 and the feed arms 105*a* and 105*b*, and the vertical driving mechanism for the feed plates 103*a* and 103*b* must be separately canceled. Thereafter, the lead frame is detached from the machine. In this way, the recovery work is cumbersome.

Also, in a motor-operated press machine of the crank press type, when a working die is replaced, for example, the bottom dead center of a press ram is adjusted so as to obtain a predetermined working accuracy. The bottom dead center of the press ram is adjusted in, for example, one of the following methods. A vertical movement shaft is threadably coupled to a slide, and the vertical movement shaft is rotated with respect to the slide, thereby adjusting the level of the slide (Japanese Patent Unexamined Publication No. HEI 5-123900). A crank shaft is configured so that its eccentric position is variable, and the adjustment is performed by adjusting the amount of eccentricity (Japanese Patent Unexamined Publication No. HEI 3-216296). The adjustment is performed by changing the position of a fulcrum of a rocker arm which pushes the ram (Japanese Patent Unexamined Publication No. HEI 4-157098).

In the case where, in a usual press machine, a working die is to be replaced, an upper die is removed from the press ram, the press ram is then moved above so as not to obstruct the replacing work, and the die is replaced. In a motor-operated press machine, the range of stroke of the press ram depends on the range of movement of the eccentric shaft of the crank. Hence, the range of stroke of the press ram is set to a relatively large value, and when the die is to be replaced, the replacing work is conducted after the press ram is moved to the uppermost position.

In such a motor-operated press machine of the prior art, the range of stroke for working is set as required for a press working operation. In replacement of the die or during maintenance, therefore, the die opening operation cannot be easily conducted. Furthermore, such a press machine has a structure in which, also in the case where the bottom dead center of the press ram is to be finely adjusted, the range of adjustment is small and therefore the adjustment cannot be readily performed.

Furthermore, the use of such a motor-operated press machine produces another problem in that, in the case where a trouble such as that a workpiece is erroneously fed to damage the die occurs during press working, it is impossible to immediately stop the press machine so as to prevent the die from being damaged. That is, when such a trouble occurs during press working, the press machine is stopped without delay to avoid a serious trouble. However, the inertia of the press ram or the like may make it impossible to immediately stop the press machine. In a resetting operation after jamming, correction cannot be manually conducted while inserting the operator's hand between the dies, with the result that the resetting operation requires a prolonged time period.

In order to solve these problems, the assignee of the present application has developed a motor-operated press machine disclosed in Japanese Patent Unexamined Publication No. HEI 8-150499.

In the motor-operated press machine, as shown in FIGS. 4 and 5, a press ram 114 is linked to a crank 120 which is rotated by a motor, thereby vertically reciprocating the press ram 114. A rocking link 126 is rockably supported on a supporting shaft 24 which is pivotally supported on a casing 112 disposed on a top plate 110 of the press machine. A crank shaft 122 which is a support shaft of the crank 120 is supported on one end portion of the rocking link 126. A driving rod 132 of an air cylinder 130 is engaged with the other end portion of the rocking link 126 which is on the opposite side with respect to the supporting shaft 124.

In a usual press working operation, as shown in FIG. 4, the air cylinder 130 upward extends the driving rod 132 so as to regulate the position of the rocking link 126 in an arrangement in which the crank shaft 122, the supporting shaft 124, and the press ram 114 are substantially on a straight line. The air cylinder 130 is pivotally supported on the casing 112 by a shaft 134 so as to be rotatable. Under this state, the one end portion of the rocking link 126 is located at a position which is in a further left side in FIG. 4 with respect to the vertical downward direction, and abuts against a stopper 36 attached to the casing 112. When the crank 120 is rotated about the crank shaft 122, the press ram 114 is vertically moved via a connecting rod 118 in which the upper end is coupled with an eccentric shaft 120*a* of the crank 120 and the lower end is coupled with the press ram 114, thereby conducting a pressing operation. The projection amount of the stopper 136 is adjusted by using an adjusting knob 138, whereby the bottom dead center of the press ram 114 can be adjusted.

In a resetting operation after jamming, an emergency during a working operation, or the like, as shown in FIG. 5, the driving rod 132 of the air cylinder 130 is retracted so that the rocking link 126 is rotated in a counterclockwise direction. This causes the press ram 114 to be upward moved to a position which is higher than that in a usual press working operation, so that the press ram 114 can be moved to a retracting position.

However, this motor-operated press machine has the following problem. Since, in a usual press working operation, the crank shaft 122, the supporting shaft 124, and the press ram 114 are arranged in a vertical direction so as to be substantially on a straight line as shown in FIG. 4, the casing 112 must have a large height. As a result, the total height of the motor-operated press machine and that of the press machine itself are increased.

In the case where, in order to move the press ram 114 to the retracting position in a resetting operation after jamming or the like, the press ram 114 is upward moved via the connecting rod 118 by rotating the rocking link 126, the crank shaft 122 through which the connecting rod 118 is coupled to the rocking link 126 is upward moved from a substantially directly below position in a vertical direction along an arcuate locus. When the press ram 114 is raised to some extent, the connecting rod 118 is laterally directed as shown in FIG. 5, with the result that the connecting rod 118 is raised from the lateral side. Therefore, a large force is required for the upward movement, so that a large air cylinder must be used as the air cylinder 130, thereby producing a problem in that the size of the pressing must be likewise increased.

When jamming or the like due to a failure in an operation of feeding a workpiece occurs during a pressing work, a large force is applied to the press ram 114. In a press working operation, as described above, the rocking link 126 is located at a position which is slightly deviated from the vertical downward direction, and the rotation of the rocking link is restricted by the stopper 136. Therefore, no escape for the force is provided. This causes a further problem in that there arises a trouble that the dies (a punch and dies) and the driving mechanism are damaged.

SUMMARY OF THE INVENTION

The invention has been conducted in order to solve the problems with the prior art, and therefore an object of the invention is to provide an electric press machine in which the index time required for the operation of feeding a lead frame and press working can be shortened, the feed stroke can be easily adjusted in the case where the kind of the lead frame is changed, and, when a lead frame is erroneously set, the lead frame can be easily detached from the machine.

In order to attain the object, the invention is achieved by provision of an electric press machine which conducts press working on a lead frame in which pilot holes are formed while the lead frame is pitch fed to a press section having a press die, comprising: a feed arm having pins which are engageable with the pilot holes of the lead frame; a feeding mechanism which reciprocates the feed arm in a direction of transporting the lead frame; a feed plate which, in the press section, guides and supports the lead frame in a movable manner in the transporting direction, and which is disposed so as to be vertically movable; a feed plate vertically moving mechanism which vertically moves the feed plate; a drive transmitting mechanism which drives the press section, and which rotates a feed cam and a raising cam to transmit driving to the feeding mechanism and the feed plate vertically moving mechanism, the feed cam and the raising cam being disposed on a cam shaft; and an electric motor which operates the drive transmitting mechanism, and in the feeding mechanism, a movable body is linked with a rocking arm which is pressingly contacted via a movable fulcrum with the feed cam and which rocks about a stationary fulcrum, rocking movement of the rocking arm is converted into linear movement of the movable body which is directly coupled to reciprocal movement of the feed arm, and a distance between the stationary fulcrum of the rocking arm and the movable fulcrum is changed in a longitudinal direction of the rocking arm, thereby enabling a feed stroke of the feed arm to be linearly changed.

Preferably, when the electric motor is started, the drive transmitting mechanism reciprocates the press die, and rotates the cam and the raising cam which are disposed on the same cam shaft, to alternatingly conduct forward movement or backward movement of the feed arm, and upward movement or downward movement of the feed plate, thereby pitch feeding the lead frame.

Preferably, in the feeding mechanism, the movable fulcrum is movably linked with a guide groove which is formed in the longitudinal direction of the rocking arm, and, in accordance with rocking movement of the rocking arm, a position of the movable fulcrum is reciprocated along the guide groove, thereby converting rocking movement of the rocking arm into linear movement of the movable body.

Preferably, the machine further comprises movable fulcrum moving means for changing a distance between the stationary fulcrum of the rocking arm and a linked position of the movable fulcrum, and the movable fulcrum moving means is driven to change the linked position of the movable fulcrum along the guide groove which is formed in the longitudinal direction of the rocking arm.

Preferably, the feed plate vertically moving mechanism vertically moves the feed plate via a toggle link mechanism which is opened and closed in linkage with a vertically moving lever which is rotated with being pressingly contacted with the raising cam.

Preferably, the toggle link mechanism is configured so that, in an abnormal condition, an opening and closing cylinder is operated to enable a toggle link to be opened or closed.

Preferably, a support plate which supports the toggle link mechanism is supported by a coil spring, and the coil spring absorbs a pressing force which is exerted when the feed plate is once downward moved and then further pressingly downward moved by downward movement of the upper die.

Another object of the invention is to provide a motor-operated press machine in which an efficient press working operation with a usual stroke, and a die opening operation in a resetting operation after jamming can be easily conducted, and the total height of the motor-operated press machine can be reduced, so that, even when jamming or the like occurs, dies are prevented from being damaged.

In order to attain the object, according to the invention, there is provided a motor-operated press machine comprising: a support table; a rocking link which is attached at a middle portion to the support table by a supporting shaft, and which is rockable about the supporting shaft; a crank in which a crank shaft serving as a support shaft is rotatably supported on one end portion of the rocking link; a press ram which is linked to the crank and which is vertically reciprocated by rotating the crank; and a driving unit which is coupled to another end portion of the rocking link to rock the rocking link about the supporting shaft, thereby vertically moving the press ram, the driving unit, in a usual press working operation, regulates the rocking link to a lateral position with respect to a position above the press ram so that the supporting shaft is on a first straight line which laterally elongates from the crank shaft with respect to a moving direction of the press ram, and, in a resetting operation after jamming or an emergency during a working operation, lowers the other end portion of the rocking link to upward move the press ram to a retracting position above a position where the press ram is located in the usual press working operation.

As described above, the rocking link is located at a lateral position with respect to the press ram which is vertically reciprocated. Therefore, the total height of the motor-operated press machine can be reduced as compared with the case where a rocking link is vertically placed above a press ram as in the prior art.

Furthermore, in a resetting operation after jamming or the like, the rocking link can be rotated so that the press ram is upward moved in a substantially directly upward direction to the retracting position. Therefore, the upward movement can be conducted more efficiently than that in the prior art in which a press ram is raised from a lateral side.

The driving unit may comprise: a first link member which is rotatably coupled at an upper end portion to the other end portion of the rocking link, by a first shaft; a second link member which is rotatably coupled at the upper end portion to a lower end portion of the first link member, by a second shaft, and which is rotatably coupled at the lower end portion to a predetermined portion of the support table below the other end portion of the rocking link, by a third shaft; rotating means for rotating the second link member about the third shaft; and a stopper mechanism which is disposed on the support table, and which abuts against the first or second link member to restrict rotation of the second link member in a direction toward the press ram, and the rotating means, in the press working operation, rotates the second link member in the direction toward the press ram, thereby causing the first or second link member to abut against the stopper mechanism under a state where the second shaft is moved toward the press ram beyond a second straight line connecting the first shaft and the third shaft, and, in the resetting operation, an emergency, or the like, rotates the second link member in a direction opposite to the press ram to move the second shaft in a direction opposite to the press ram with respect to the second straight line, thereby lowering the other end portion of the rocking link. According to this configuration, in a press working operation, the rocking link is prevented from rocking due to a repulsive force acting on the press ram.

The stopper mechanism may be configured so as to abut against a portion of the first link member which is lower in level than the second shaft, or a portion of the second link member which is higher in level than the second shaft. According to this configuration, the force which is applied to the stopper from the press ram via the rocking link can be reduced, and hence the stopper can be miniaturized.

The stopper mechanism may be configured so that receives a force of a degree larger than a preset degree from the first or second link member abutting against the stopper mechanism, the stopper mechanism enables the second link member to rotate in the direction toward the press ram. According to this configuration, even when jamming or the like due to a failure in an operation of feeding a workpiece occurs during a pressing work and a large force is applied to the press ram, the stopper can absorb the force, so that dies and the pressing machine can be prevented from being damaged.

Specifically, the stopper mechanism may comprise: a stopper body which is movable along a moving direction of the second shaft; an urging member which always urges the stopper body in a direction in which the stopper body is separated from the press ram; and a restricting member which abuts against the stopper body to restrict a movement of the stopper body toward the second shaft.

Alternatively, the stopper may be provided with an adjusting mechanism which adjusts a restriction position of the stopper body and determined by the restricting member to adjust a rotation amount of the first or second link member in the direction toward the press ram, thereby finely adjusting a bottom dead center of the press ram in the press working operation.

The above and other objects and features of the present invention will be more apparent from the following description taken in conjunction with the accompanying drawings.

DETAILED DESCRIPTION OF THE PREFERRED EMBODIMENTS

Hereinafter, preferred embodiments of the invention will be described with reference to the accompanying drawings.

The embodiment is an electric press machine in which a press die for the D/D (Deflash and Dambar cut system) is mounted.

Figure 1:
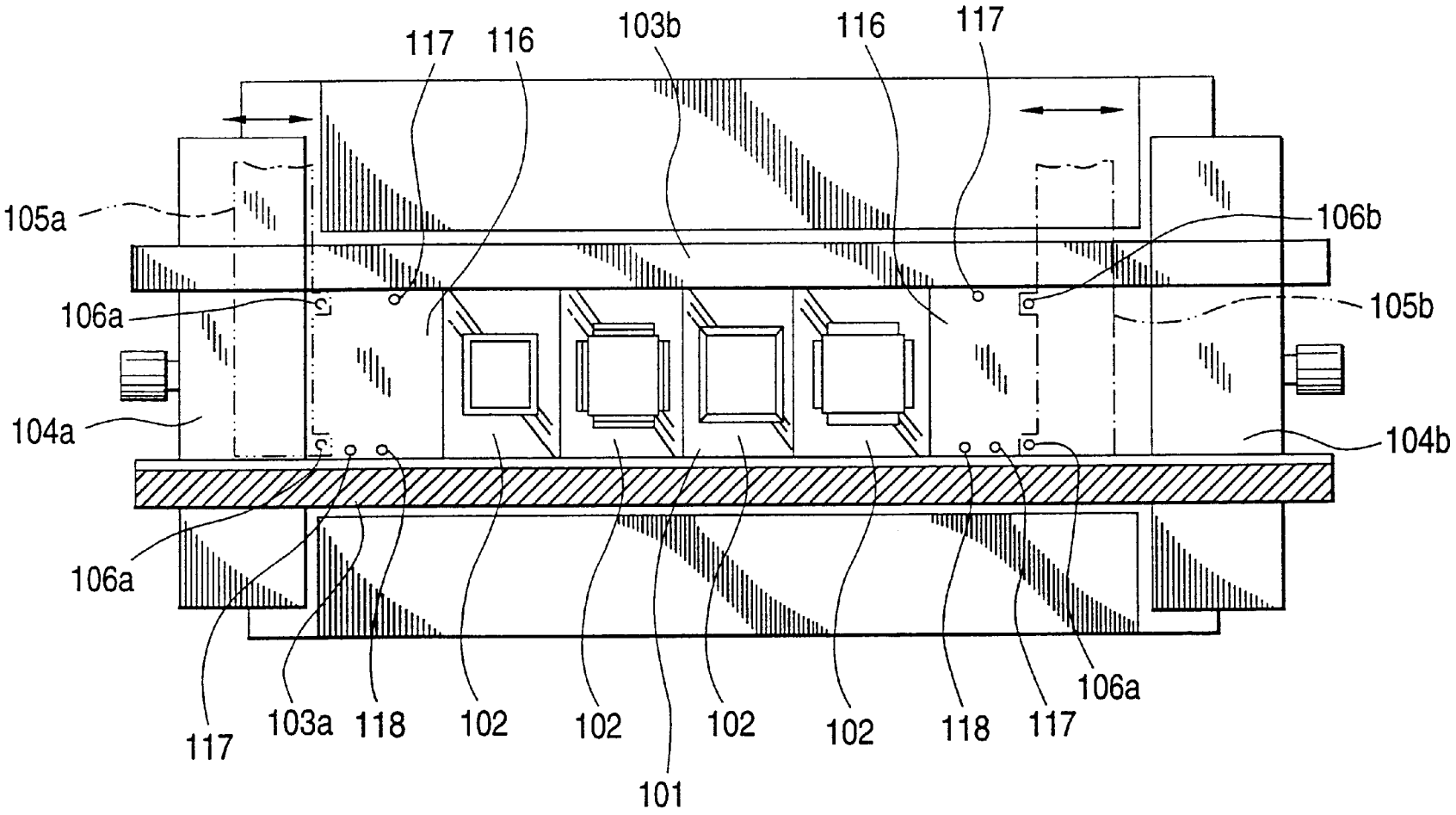
FIG. 1 PRIOR ART
FIG. 1 is a plan view of a press machine of the prior art.
Figure 2:
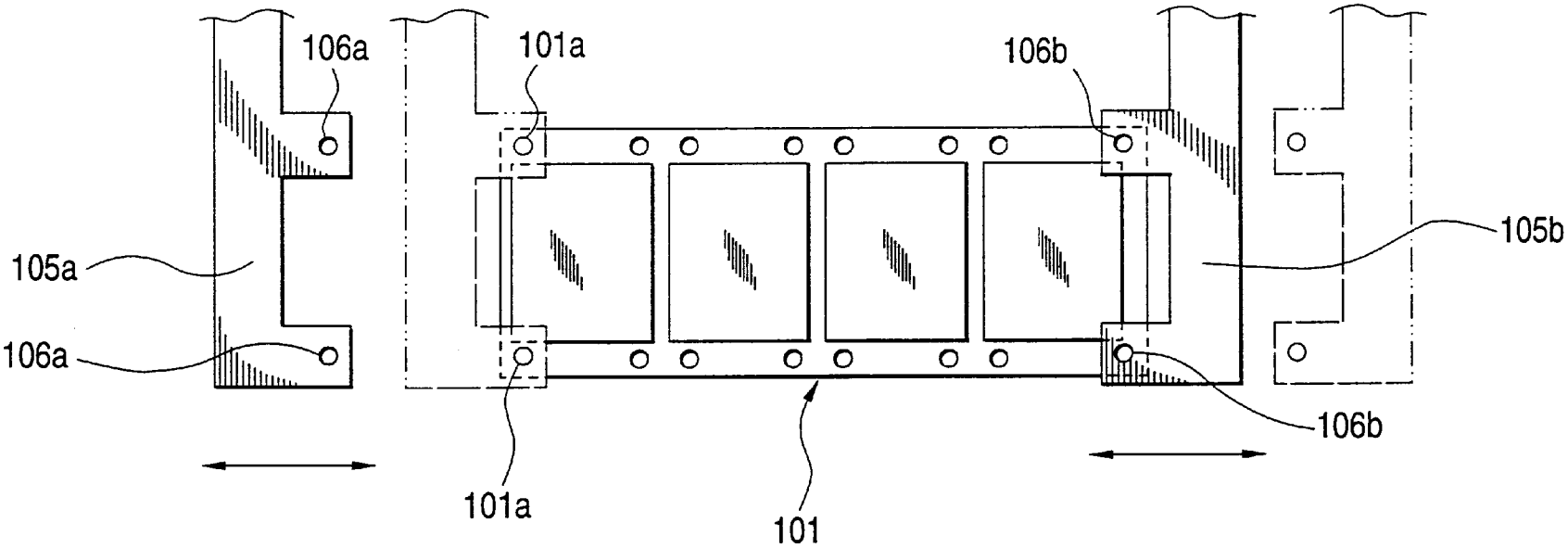
FIG. 2 PRIOR ART
FIG. 2 is an explanatory diagram of a feed arm in the press machine of the prior art.
Figure 3:
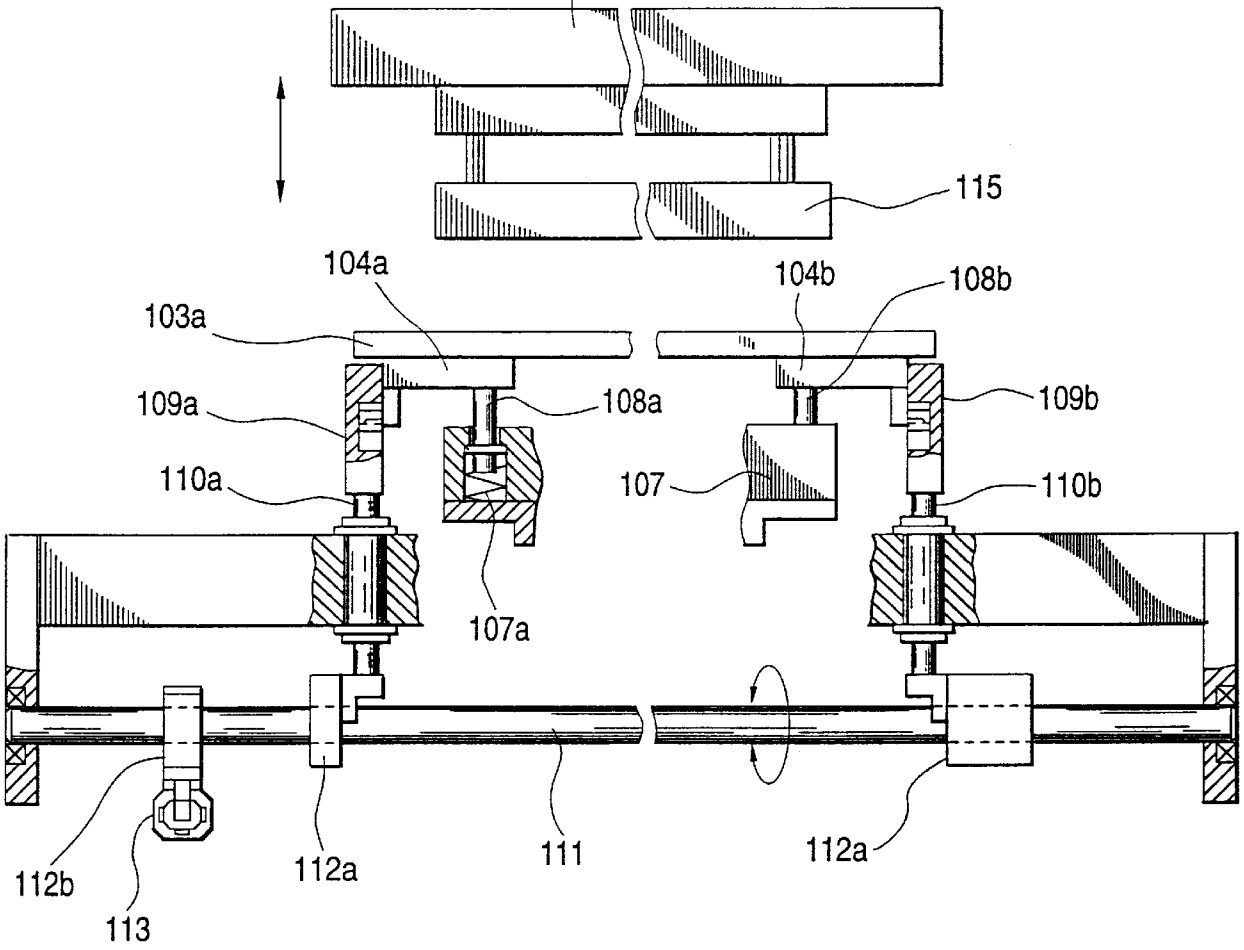
FIG. 3 PRIOR ART
FIG. 3 is an explanatory diagram showing the configuration of a feed plate vertically moving mechanism of the prior art.
Figure 4:
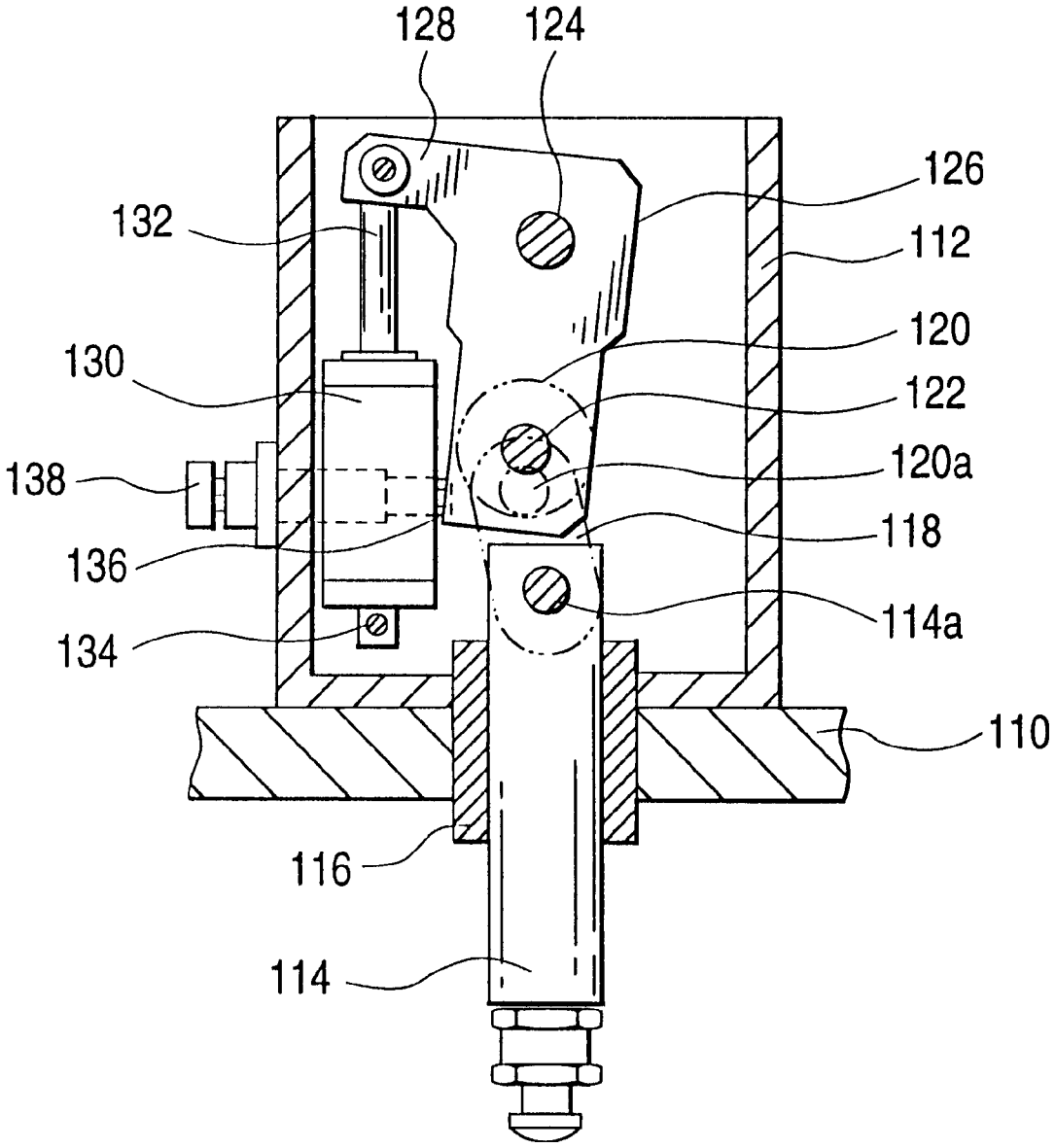
FIG. 4 PRIOR ART
FIG. 4 is an explanatory diagram showing the configuration of various portions of a motor-operated press machine of the prior art in a working state with a usual stroke.
Figure 5:
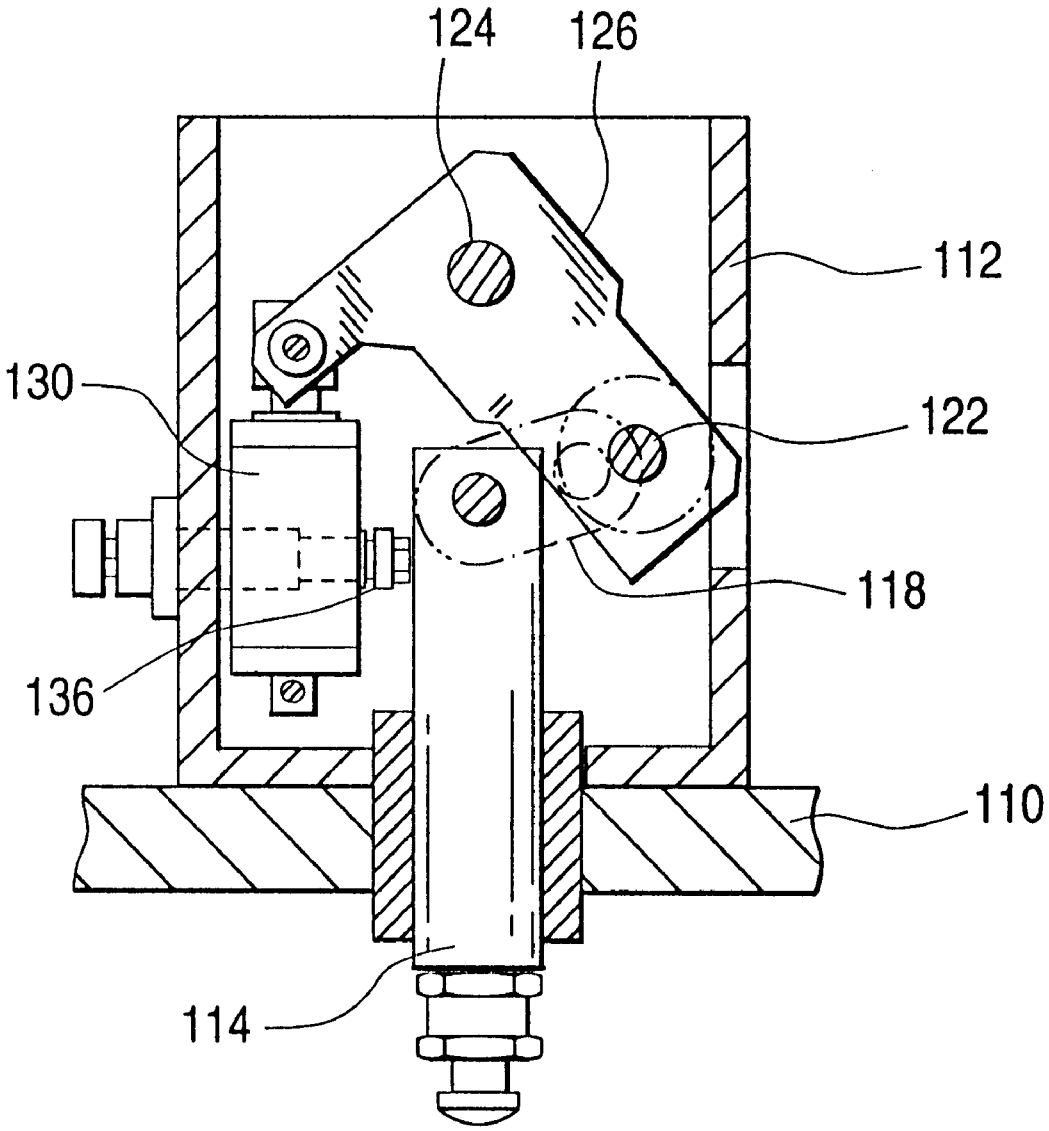
FIG. 5 PRIOR ART
FIG. 5 is an explanatory diagram showing the configuration of various portions of the motor-operated press machine of the prior art in a state where a press ram is moved to a retracting position of a higher level.
Figure 6:
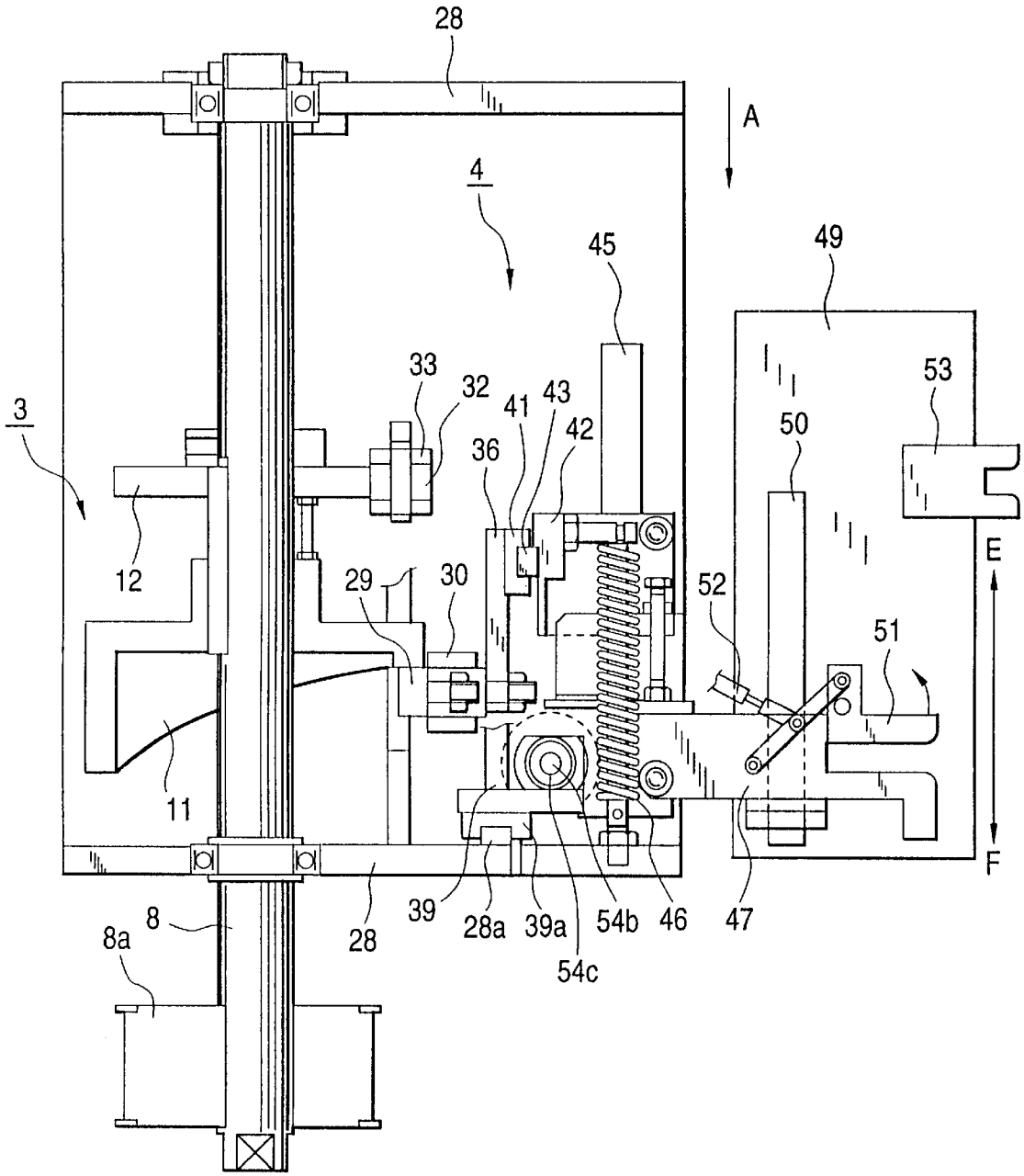
FIG. 6 is a plan view of a drive transmitting mechanism.
Figure 7:
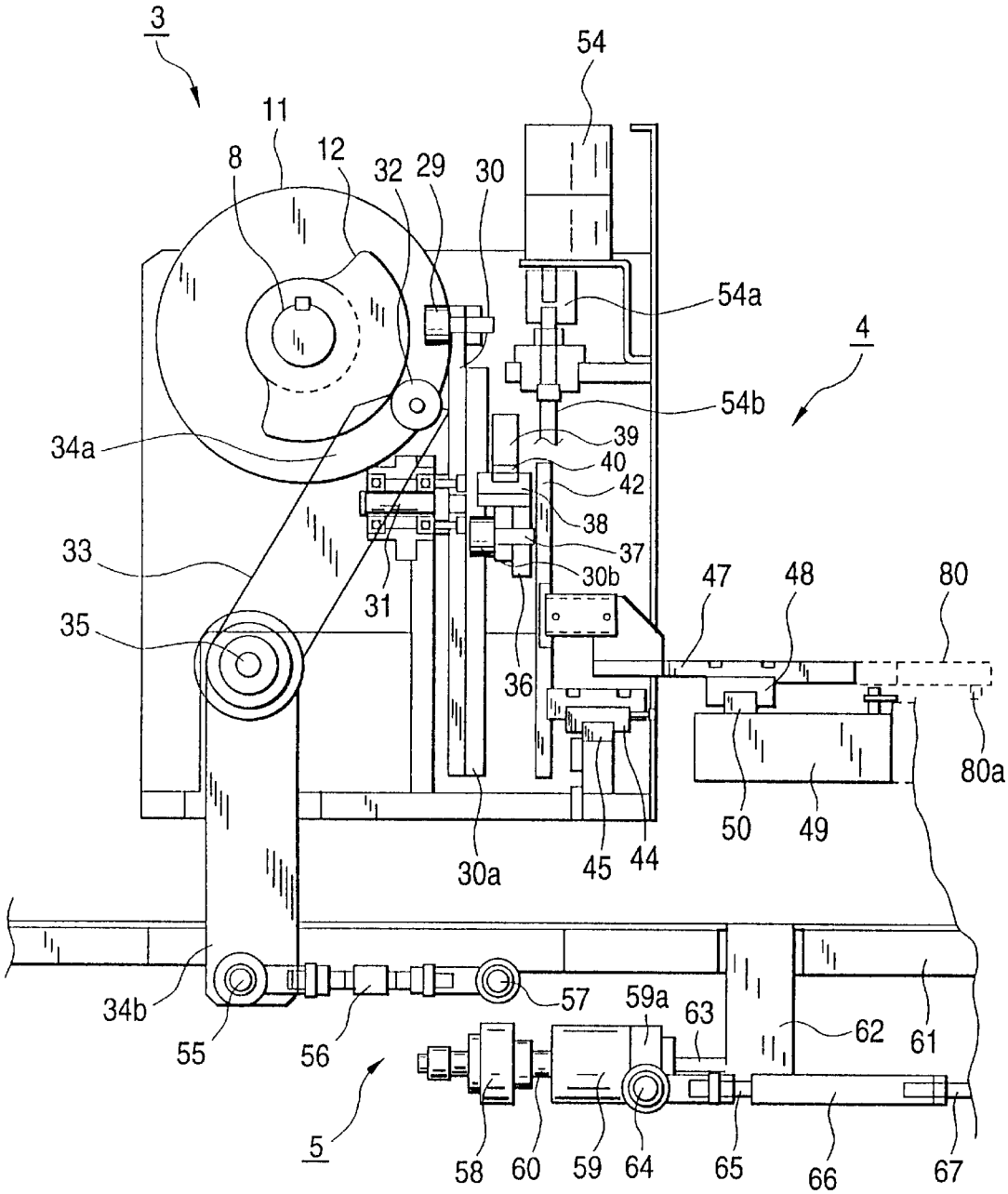
FIG. 7 is a side view of the drive transmitting mechanism of FIG. 6 and as seen in the direction of the arrow A.
Figure 8:
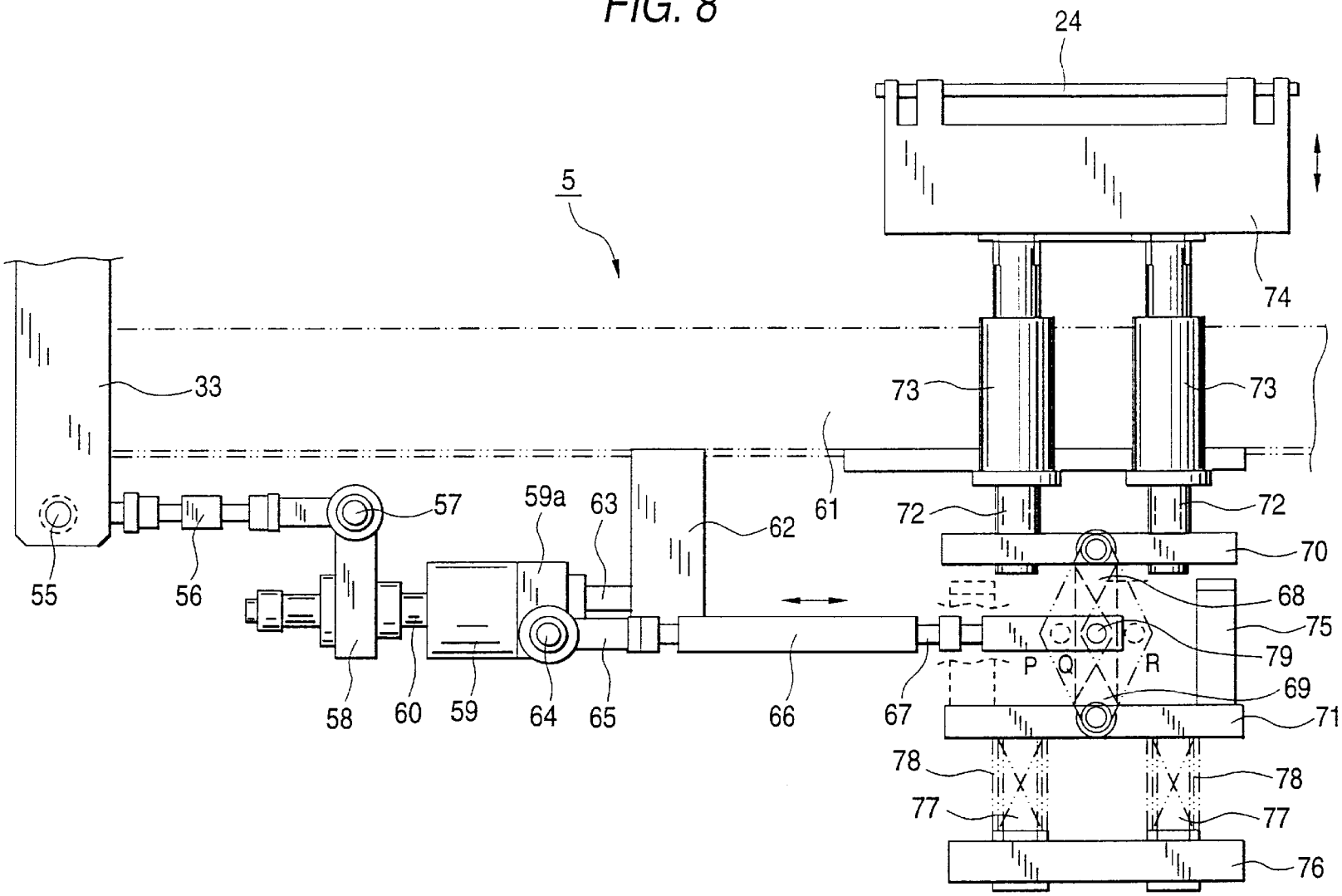
FIG. 8 is an explanatory diagram of a feed plate vertically moving mechanism.
Figure 9:
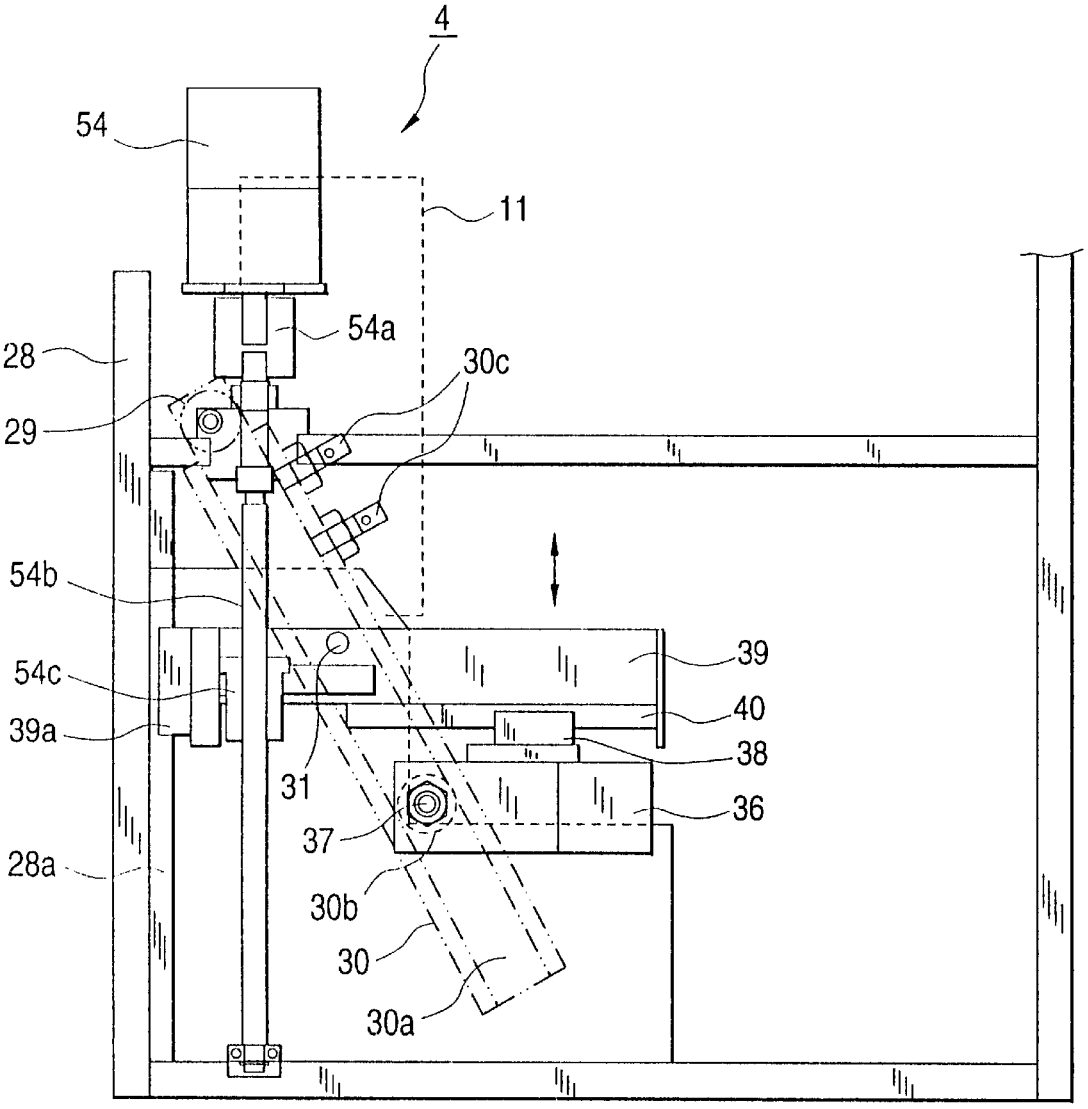
FIG. 9 is an explanatory diagram showing the configuration of main portions of a feeding mechanism.
Figure 10:
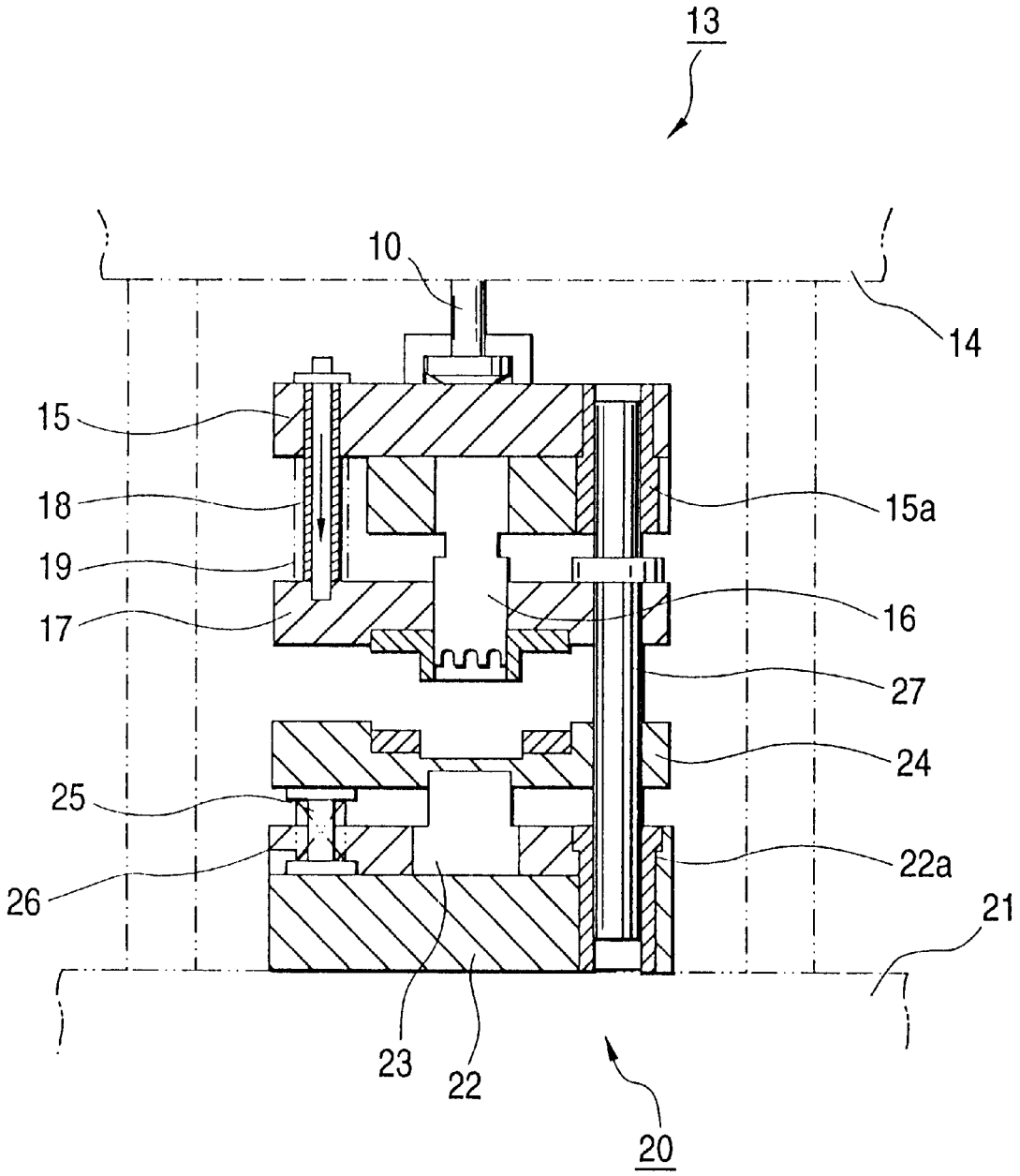
FIG. 10 is an explanatory diagram showing the configuration of a press section of the electric press machine.
Figure 11:
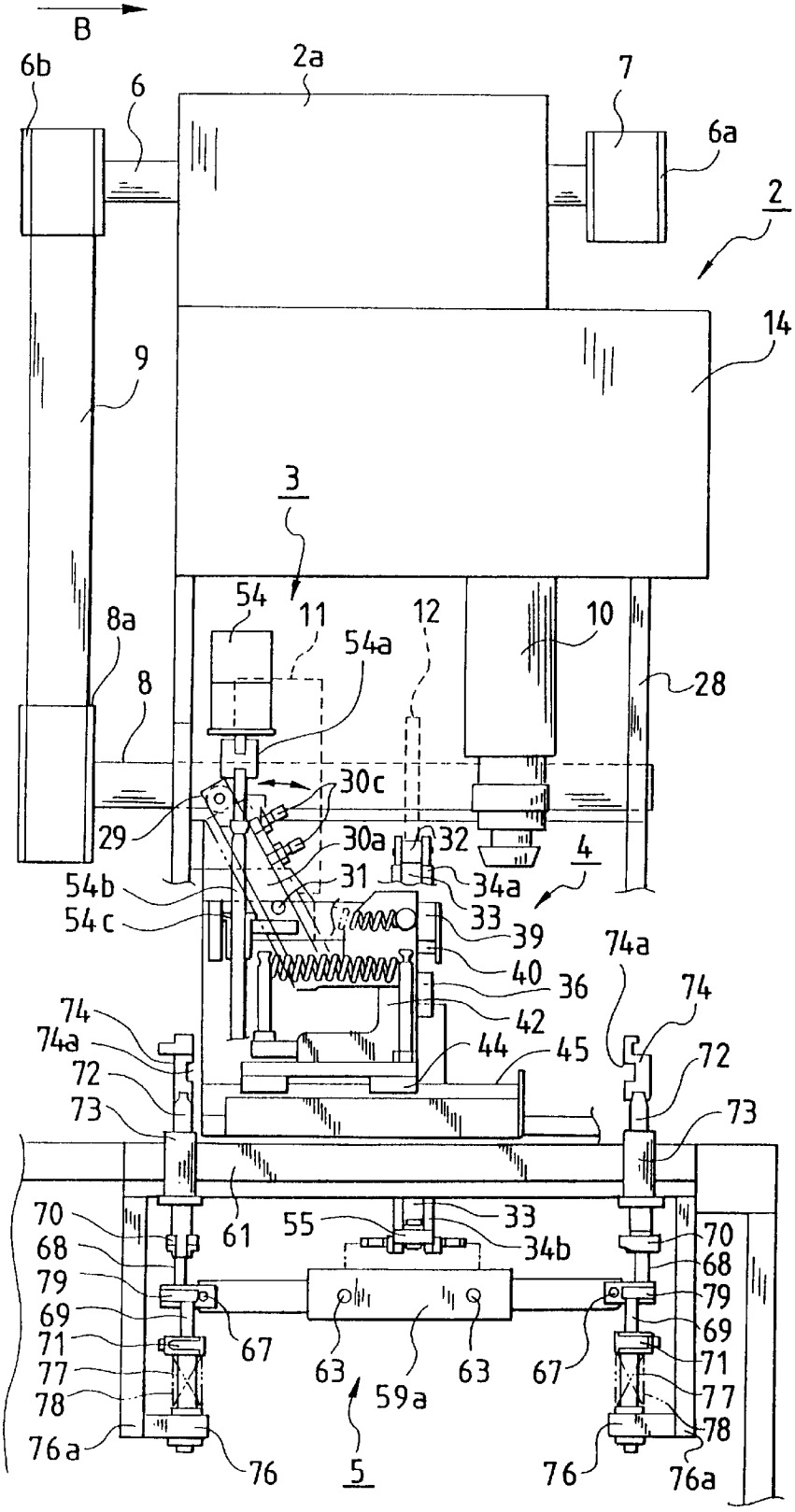
FIG. 11 is a front view schematically showing the configuration of the electric press machine.
Figure 12:
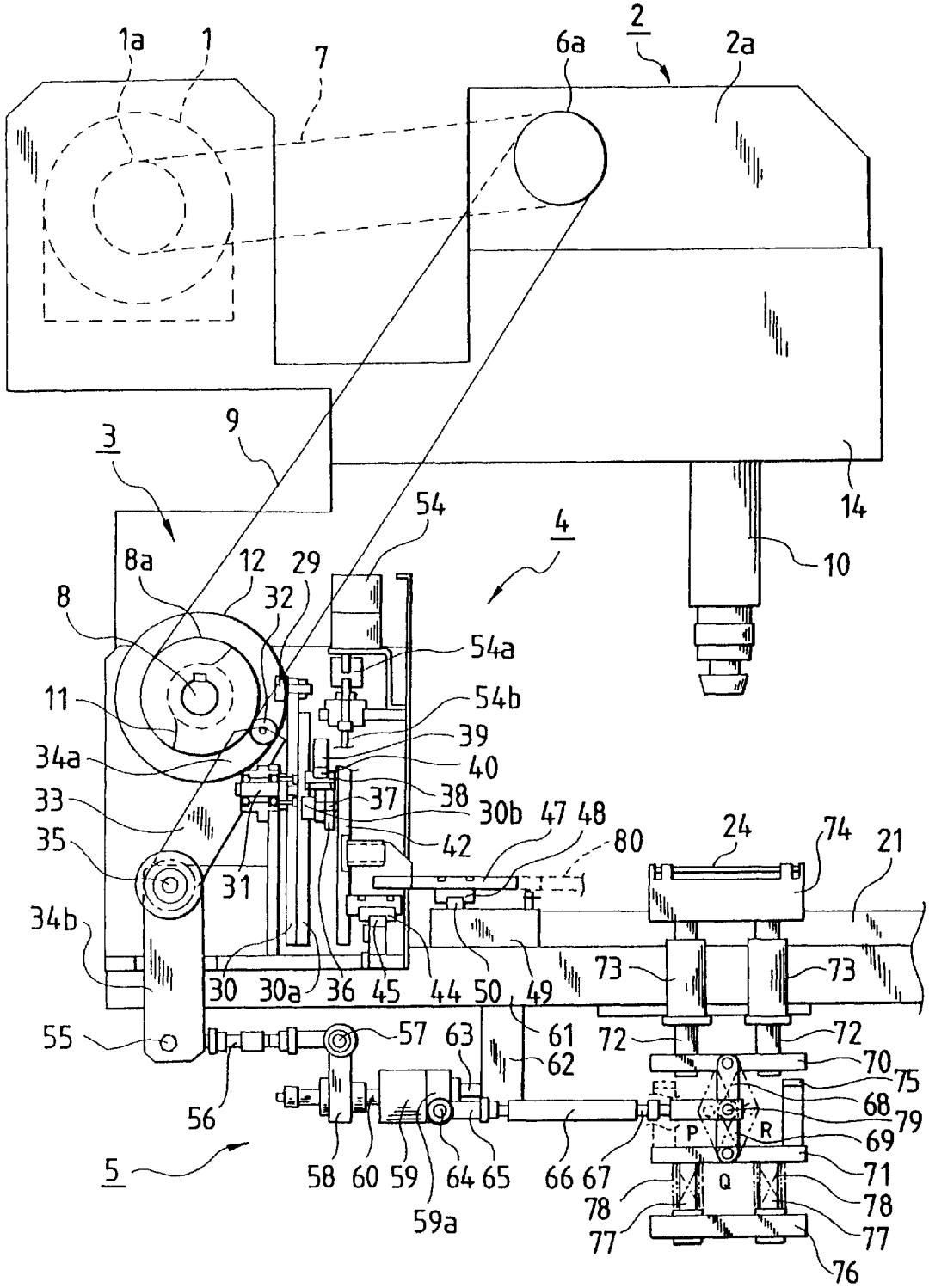
FIG. 12 is a side view of the electric press machine of FIG. 11 and as seen in the direction of the arrow B.

FIG. 6 is a plan view of a drive transmitting mechanism, FIG. 7 is a side view of the drive transmitting mechanism of FIG. 6 and as seen in the direction of the arrow A, FIG. 8 is an explanatory diagram of a feed plate vertically moving mechanism, FIG. 9 is an explanatory diagram showing the configuration of main portions of a feeding mechanism, FIG. 10 is an explanatory diagram showing the configuration of a press section of the electric press machine, FIG. 11 is a front view schematically showing the configuration of the electric press machine, and FIG. 12 is a side view of the electric press machine of FIG. 11 and as seen in the direction of the arrow B.

(Whole configuration)

First, an outline of the configuration of the electric press machine will be described with reference to FIGS. 11 and 12.

The reference numeral 1 designates an electric motor. A press section 2 is driven by the electric motor, and the driving is transmitted by a drive transmitting mechanism 3 to a feeding mechanism 4 and a feed plate vertically moving mechanism 5 which will be described later. The configuration of the press section 2 is shown in FIG. 10, and hence not illustrated in FIGS. 11 and 12.

Specifically, a timing belt 7 is looped around a motor pulley la disposed on the output shaft of the electric motor 1, and a first pulley 6*a* disposed at one end of a supporting shaft 6 of the press section 2. The supporting shaft 6 is rotatably supported on a bearing section 2*a* disposed in an upper portion of the press section 2. A timing belt 9 is looped around a second pulley 6*b* disposed at the other end of the supporting shaft 6, and a cam shaft pulley 8*a* disposed at one end of a cam shaft 8 of the drive transmitting mechanism 3. A third pulley which is not shown is disposed on the supporting shaft 6. A timing belt is looped around the third pulley and a pulley disposed on a crank shaft which is not shown.

When the electric motor 1 is started, the supporting shaft 6 is rotated via the timing belt 7, and the crank shaft is rotated via the timing belt which is not shown, whereby a crank is rotated so as to vertically move a press ram 10 which is coupled to the crank via a connecting rod. The press ram 10 is coupled to an upper die side of the press section 2.

The cam shaft 8 is rotated via the timing belt 9 by the supporting shaft 6, and a feed cam 11 and a raising cam 12 which are attached to the cam shaft 8 are rotated, thereby transmitting the driving to the feeding mechanism 4 and the feed plate vertically moving mechanism 5. The feeding mechanism 4 reciprocates a feed arm having pins which are engageable with pilot holes that are opened in side rails of a lead frame, so that the lead frame is pith fed. The feed plate vertically moving mechanism 5 guides the transportation of the lead frame in the press section 2 and vertically moves feed plates in synchronization with the operation of pitch feeding the lead frame.

Next, the configuration of various portions of the electric press machine will be described with reference to FIGS. 6 to 10.

(Press section)

First, the configuration of the press section 2 will be described with reference to FIG. 10. The reference numeral 13 designates an upper die. An upper-die driving mechanism (not shown) comprising the crank and the connecting rod is disposed in a press casing 14 which is disposed above the upper die 13. The lower end of the press ram 10 is coupled to a punch holder 15. The press ram 10 is driven by the upper-die driving mechanism to vertically move the punch holder 15. A punch 16 is held by the punch holder 15. A tip end portion of the punch 16 is passed through a stripper plate 17 so as to be guided thereby.

The punch holder 15 and the stripper plate 17 are coupled together by an upper-die support post 18. A coil spring 19 is disposed around the upper-die support post 18 so as to downward urge the stripper plate 17.

The reference numeral 20 designates a lower die. The feed plate vertically moving mechanism 5 which will be described later in detail is disposed below a press head 21 of the lower die 20. A die holder 22 is disposed on the press head 21. The die holder 22 holds a die 23. A feed plate 24 which guides and supports the lead frame so as to be movable in the transporting direction in the press section 2 is disposed above the die 23 in a vertically movable manner. The feed plate 24 is coupled to a lower-die support post 25 which stands from the die holder 22. A coil spring 26 is disposed around the lower-die support post 25 so as to upward urge the feed plate 24.

A guide post 27 is vertically disposed between the punch holder 15 and the die holder 22. The guide post is passed through the stripper plate 17 and the feed plate 24 so as to perform the positioning of the upper and lower dies 13 and 20. Upper and lower end portions of the guide post 27 are passably guided by guide bushes 15*a* and 22*a* disposed on the punch holder 15 and the die holder 22, respectively. The guide bushes 15*a* and 22*a* are fixed after the die alignment of the punch 16 and the die 23 is performed. The stripper plate 17 and the feed plate 24 are guided so as to be perpendicular to the guide post 27.

(Drive transmitting mechanism)

Next, the configuration of the drive transmitting mechanism 3 will be described with reference to FIG. 6.

As described above, the cam shaft 8 is rotated by transmitting the driving force of the electric motor 1 to the cam shaft pulley 8*a*. Both the ends of the cam shaft 8 are rotatably supported on a machine frame 28 which accommodates the drive transmitting mechanism. The feed cam 11 and the raising cam 12 are coaxially fitted onto the cam shaft 8. The feed cam 11 transmits the driving of the cam shaft 8 to the feeding mechanism 4, and the raising cam 12 transmits the driving of the cam shaft 8 to the feed plate vertically moving mechanism 5. The feed cam 11 forms a cam curve in which, at the start of and before the stop of the feeding operation of the lead frame by the feed arm, the feeding operation is conducted at a low speed, and, during the feeding operation, the feeding operation is conducted at a high speed. The raising cam 12 forms a cam curve in which, at the start of and before the stop of the vertical movement of the feed plate 24, the vertical moving operation is conducted at a low speed, and, during the movement, the vertical moving operation is conducted at a high speed.

The reference numeral 29 designates a feed-cam roller which abuts against the operating surface of the feed cam 11. The feed-cam roller 29 is rotatably supported on one end of a rocking arm 30. The rocking arm 30 is supported so as to be rockable about a first fulcrum 31 serving as a stationary fulcrum. Coil springs which are not shown are engaged with coil spring engagement portions 30*c* so that the rocking arm is always urged in a clockwise direction (see FIG. 9).

The reference numeral 32 designates a raising-cam roller which abuts against the operating surface of the raising cam 12. The raising-cam roller 32 is rotatably supported on one end 34*a* of a vertically moving lever 33. The vertically moving lever 33 is pivotally supported so as to be rockable about a support shaft 35, and is always urged by a coil spring (not shown) in a counterclockwise direction so that the raising-cam roller 32 is always urged against the operating surface of the raising cam 12. The other end 34*b* of the vertically moving lever 33 is coupled at a fulcrum 55 to one end of a link member 56 of the feed plate vertically moving mechanism 5 which will be described later.

When the one end 34*a* of the vertically moving lever 33 is caused by the rotation of the raising cam 12 to rock about the support shaft 35, therefore, the link member 56 which is coupled at the fulcrum 55 to the other end 34*b* is laterally reciprocated (see FIG. 7).

(Feeding mechanism)

Next, the configuration of the feeding mechanism 4 will be described.

Referring to FIG. 9, a guide groove 30*a* is formed in the rocking arm 30 along the longitudinal direction of the arm. A second fulcrum 37 serving as a movable fulcrum is disposed on a second-fulcrum plate 36 constituting a part of a movable body. A guide roller 30*b* is rotatably supported on the second fulcrum 37. The guide roller 30*b* is fitted into the guide groove 30*a* of the rocking arm 30 so as to couple the rocking arm 30 and the second-fulcrum plate 36 together. A slide member 38 is disposed on the second-fulcrum plate 36. The slide member 38 is fitted into a slide rail 40 disposed on a second-fulcrum raising plate 39.

When the rocking arm 30 rocks, the guide roller 30*b* is moved in the guide groove 30*a* while rotating, and the slide member 38 is reciprocated along the slide rail 40, thereby converting rocking movement of the rocking arm 30 into linear movement of the second-fulcrum plate 36.

As shown in FIG. 6, a first vertical movement slide guide 41 is disposed on a part of the second-fulcrum plate 36. The first vertical movement slide guide 41 is fitted into a first vertical movement slide rail 43 disposed on a feed slide member 42 constituting a part of the movable body. The feed slide member 42 is fitted into a first feed slide rail 45 via a first feed slide guide 44 (see FIG. 7) disposed on the rear face. The feed slide member 42 is reciprocable along the first feed slide rail 45 with being integrated with the second-fulcrum plate 36, and usually pulled by a coil spring 46 and waits at a home position on one side of the machine frame 28 (the lower side of FIG. 6).

A feed arm attachment member 47 is integrally attached to the feed slide member 42. The feed arm attachment member 47 is fitted into a second feed slide rail 50 disposed on a support plate 49 via a second feed slide guide 48 (see FIG. 7) disposed on the rear face. The feed arm attachment member 47 is reciprocable along the second feed slide rail 50 with being integrated with the feed slide member 42.

Referring to FIG. 6, a feed arm attachment guide 51 is disposed on the feed arm attachment member 47. The feed arm attachment guide 51 is attached so as to be opened and closed by a feed arm attachment cylinder 52, so that a feed arm 80 (see FIG. 7) is surely attached and detached.

A guide block 53 is disposed on the support plate 49. Dies such as the die holder 22 of the press section 2 are guided by the guide block, with the result that the attachment accuracy can be improved.

When the rocking arm 30 rocks, therefore, the second-fulcrum plate 36 is reciprocated along the slide rail 40 of the second-fulcrum raising plate 39 as shown in FIG. 9, and, at the same time, the feed slide member 42 coupled to the second-fulcrum plate 36 is reciprocated against the urging force of the coil spring 46 along the first feed slide rail 45 as shown in FIG. 6. At this time, also the feed arm attachment member 47 coupled to the feed slide member 42 is reciprocated along the second feed slide rail 50, and the pitch feeding is conducted while a pin 80*a* (see FIG. 7) of the feed arm 80 attached to the feed arm attachment member 47 remains to be engaged with the pilot hole of the lead frame.

Referring to FIG. 9, 54 designates a fulcrum moving motor serving as movable fulcrum moving means and for changing the distance between the first and second fulcrums 31 and 37 of the rocking arm 30. Specifically, a ball screw 54*b* is vertically attached via a coupling 54*a* to the output shaft of the fulcrum moving motor 54. A nut 54*c* attached to the second-fulcrum raising plate 39 is screwed with the ball screw 54*b*. When the ball screw 54*b* is rotated, the second-fulcrum raising plate 39 is vertically moved via the nut 54*c*. A second vertical movement slide guide 39*a* is disposed on a part of the second-fulcrum raising plate 39, and is fitted into a second vertical movement slide rail 28*a* which is vertically formed on the machine frame 28.

When the fulcrum moving motor 54 is rotated in a given direction, therefore, the second-fulcrum raising plate 39 is vertically moved along the second vertical movement slide rail 28*a*, and the second-fulcrum plate 36 which is coupled via the slide member 38 to the second-fulcrum raising plate 39 is vertically moved along the first vertical movement slide rail 43 (see FIG. 6).

At this time, the guide roller 30*b* is moved along the guide groove 30*a* in the longitudinal direction of the rocking arm 30. When the distance between the first and second fulcrums 31 and 37 is shortened, for example, the amplitude of the rocking arm 30 is reduced. In proportion to the change of the amplitude, therefore, the range of the reciprocal movement of the second-fulcrum plate 36 is narrowed, and the movement range of the feed slide member 42 which is reciprocated integrally with the second-fulcrum plate 36, and that of the feed arm attachment member 47 coupled to the plate are narrowed. As a result, the feed stroke of the feed arm 80 is reduced. Similarly, when the distance between the first and second fulcrums 31 and 37 is lengthened, the amplitude of the rocking arm 30 is increased. In proportion to the change of the amplitude, therefore, the range of the reciprocal movement of the second-fulcrum plate 36 is widened, and the feed stroke of the feed arm 80 is increased.

In this way, when the guide roller 30*b* disposed at the second fulcrum 37 is moved along the guide groove 30*a* of the rocking arm 30 by driving the fulcrum moving motor 54 so as to change the distance between the first and second fulcrums 31 and 37, the rocking range of the rocking arm 30 can be changed. Therefore, the feed stroke of the feed arm 80 can be linearly changed. In the embodiment, the feed stroke of the feed arm 80 can be arbitrarily changed in the range of about 8 to 55 mm by driving the fulcrum moving motor 54.

Particularly, because rocking movement of the rocking arm 30 is converted into linear movement of the second-fulcrum plate 36 which is directly coupled to reciprocal movement of the feed arm 80, without using interposed plural links, it is easy to calculate the amount of the feed stroke of the feed arm 80. Even when the kind of the lead frame is changed, therefore, the adjustment of the feed stroke can be conducted very easily. Consequently, the machine has very excellent operability and workability.

Since the number of linked parts such as rocking arm members is small, the maintenance is easily performed and the production cost can be lowered.

(Feed plate vertically moving mechanism)

Next, the configuration of the feed plate vertically moving mechanism 5 will be described with reference to FIGS. 7 and 8.

The raising-cam roller 32 disposed at the one end 34*a* of the vertically moving lever 33 is pressingly contacted with the raising cam 12. When the vertically moving lever 33 is caused to rock about the support shaft 35 by the raising cam 12, a link member 56 one end of which is coupled to a fulcrum 55 disposed at the other end 34*b* is laterally reciprocated.

The other end of the link member 56 is coupled at a fulcrum 57 to one end of a link member 58. The other end of the link member 58 is coupled to a cylinder rod 60 of an opening and closing cylinder 59. The cylinder rod 60 may be in either of the extension state or the contraction state. In the embodiment, the cylinder rod 60 is in the contraction state. The opening and closing cylinder 59 is attached to two portions of a cylinder support member 59*a* which are arranged in the longitudinal direction of the member (see FIG. 11). The cylinder support member 59*a* is attached so as to be movable in the lateral direction in FIG. 7, to a cylinder guide 63 which are horizontally attached to a cylinder guide attachment member 62 hanging from a base plate 61. When the feed plate 24 is to be vertically moved, the opening and closing cylinder 59 functions merely as a link member. The support plate 49, the press bed 21, and the like are disposed on the base plate 61 (see FIG. 12).

A link member 65 which is disposed at one end of a link case 66 is coupled at a fulcrum 64 to a cylinder case of the opening and closing cylinder 59. A link member 67 is coupled to an opening and closing fulcrum 79 which is disposed at one end of each of toggle links 68 and 69. The other ends of the toggle links 68 and 69 are rotatably coupled to upper and lower joint plate 70 and 71, respectively. The lower joint plate 71 is a support plate which supports the toggle mechanism. When the toggle links 68 and 69 are opened and closed, the feed plate 24 is vertically moved with respect to the lower joint plate 71.

Lower ends of feed plate support members 72 are coupled to the upper joint plate 70. The feed plate support members are passed through bearing members 73 fitted into the base plate 61. An engagement member 74 is coupled to the upper ends of the feed plate support members. The feed plate 24 is engaged with an engagement recess 74*a* of the engagement member 74 so as to be supported thereon.

A bump member 75 stands from the upper face of the lower joint plate 71. When the toggle links 68 and 69 are bent and the feed plate 24 is downward moved, the upper joint plate 70 bumps against the bump member to be supported thereon, thereby regulating the range of the downward movement. A spring receive plate 76 is disposed below the lower joint plate 71. The spring receive plate 76 is attached to a spring receive plate attachment member 76*a* hanging from the base plate 61. Guide posts 77 hang from the lower face of the lower joint plate 71. The lower ends of the guide posts are passably fitted into the spring receive plate 76. A coil spring 78 is fitted around each of the guide posts 77 so as to always upward urge the lower joint plate 71.

As shown in FIG. 11, the thus configured toggle link mechanism is disposed on each side of the other end 34*b* of the vertically moving lever 33, and the right and left sides of the feed plate 24 are supported by the engagement members 74 in a vertically movable manner, respectively.

When the raising cam 12 shown in FIG. 7 is rotated, therefore, the vertically moving lever 33 rocks about the support shaft 35, and the opening and closing fulcrum 79 of the toggle links 68 and 69 is reciprocated between positions P and Q via the plural link members such as the opening and closing cylinder 59 shown in FIG. 8. As a result, the toggle links 68 and 69 are opened and closed, and the feed plate 24 engaged with the engagement members 74 coupled to the upper ends of the feed plate support members 72 coupled to the upper joint plate 70 is vertically moved. In the toggle links 68 and 69, when the cylinder rod 60 of the opening and closing cylinder 59 is in the extension state, the opening and closing fulcrum 79 is reciprocated between positions Q and R of FIG. 8.

When a lead frame is erroneously set, or when a failure detecting pin which is not shown detects a failure of the lead frame setting, it is required to stop the operation of the machine, detach the lead frame, and reengage the lead frame with the pilot pins disposed on the die. In this case, when a failure occurs during the upward movement of the feed plate 24, the feed plate 24 must be once downward moved. When a failure occurs during the downward movement of the feed plate 24, the feed plate 24 must be upward moved so that the lead frame is supported. At this time, the opening and closing cylinder 59 of the toggle link mechanism is manually operated so that the cylinder rod 60 is extended or contracted to open or close the toggle links 68 and 69. As a result, the lead frame can be detached and the positional misalignment can be corrected. In this way, the work of recovering a lead frame can be conducted by operating the opening and closing cylinder 59 so as to open or close the toggle links 68 and 69. Consequently, the machine has very excellent workability and operability.

In the press section 2, when the upper die 13 is downward moved and the feed plate 24 is downward moved against the urging force of the coil spring 26 which is disposed at each of the ends of the width direction of the plate, deformation such as warpage may occur as a result of a long-term use (see FIG. 10). A countermeasure against this is taken in the following manner. When the upper die 13 is downward moved, the stripper plate 17 is once downward moved until it bumps against the feed plate 24. When the feed plate 24 is further pressed down, the lower joint plate 71 is downward moved against the urging force of the coil springs 78. Therefore, the pressing force due to the upper die 13 is absorbed by the coil springs 78. At this time, the lower ends of the guide posts 77 are passed through to downward project as the compression of the coil springs 78 advances. According to this configuration, deformation of the feed plate 24 is prevented from occurring.

(Operation of feeding a lead frame)

Next, the operation of feeding a lead frame in the thus configured electric press machine will be described together with the press operation. In the embodiment, the vertical movement of the upper die 13, the reciprocal movement of the feed arm 80, and the vertical movement of the feed plate 24 are conducted in synchronization with one another by driving the electric motor 1. Therefore, the feeding operation during the period when the pressing operation for one stroke conducted on a lead frame will be described.

First, the feed plate 24 of the press section 2 is upward moved and the feed pin 80*a* of the feed arm 80 is engaged with a pilot hole of the lead frame on the feed plate 24, from the upper side. Then, the feed arm 80 is forward moved (in the direction of the arrow E of FIG. 6) so as to feed the lead frame by one pitch. Before the upper die 13 is downward moved and the stripper plate 17 presses down the feed plate 24, the feed plate 24 is downward moved so that the engagement of the feed arm 80 and the lead frame is canceled. Then, the feed arm 80 is returned to the initial position which does not correspond to the die 23 (in the direction of the arrow F of FIG. 6) (see FIG. 10).

When the upper die 13 is further downward moved, the stripper plate 17 abuts against the feed plate 24 so as to press down it, and the punch 16 enters the die 23 to conduct press working (see FIG. 10). At this time, as described above, the feed plate 24 which has once reached the downward movement allowable range is further downward pressed by the urging force of the coil spring 19. However, the pressing force acting on the feed plate 24 is absorbed as a result of the phenomenon that the lower joint plate 71 coupled to the toggle link mechanism is pressingly contracted against the urging force of the coil springs 78 (see FIG. 8).

When the press working is ended, the upper die 13 is upward moved, the feed plate 24 is upward moved and the feed pin 80*a* of the feed arm 80 is engaged with a pilot hole of the lead frame. Then the feed arm 80 is again forward moved to feed the lead frame by one pitch, and press working is repeated in the same manner.

The index time required for conducting press working for one stroke on a lead frame in the electric press machine was measured. As a result, while the index time in the prior art is about 70 spm, the index time was improved to about 200 spm and a high speed operation was realized.

According to this configuration, the upper die 13 is vertically moved by driving the electric motor 1 to conduct press working, and the operation of feeding the lead frame is conducted while the feeding mechanism 4 and the feed plate vertically moving mechanism 5 which are organically coupled together via the drive transmitting mechanism 3 are synchronized with each other. Therefore, the index time required for the operation of feeding a lead frame and press working can be remarkably shortened and the working efficiency can be enhanced.

Particularly, the configuration in which the drive transmitting mechanism 3 which transmits the driving to the feeding mechanism 4 and the feed plate vertically moving mechanism 5 is provided with the feed cam 11 and the raising cam 12 attached to the same cam shaft 8, and the cams 11 and 12 form a cam curve in which, at the start of and before the stop of the feeding operation of a lead frame, a low speed is attained, and, during the feeding operation, a high speed is attained enables the lead frame to be fed without being damaged, and breakage of the feed pin 80*a* of the feed arm 80 to be reduced.

Furthermore, the distance between the first and second fulcrums 31 and 37 is changed by driving the fulcrum moving motor 54 and moving the guide roller 30*b* disposed at the second fulcrum 37 along the guide groove 30*a* of the rocking arm 30, whereby the rocking range of the rocking arm 30 can be changed. Therefore, the feed stroke of the feed arm 80 can be linearly changed.

Particularly, because rocking movement of the rocking arm 30 is converted into linear movement of the movable bodies such as the second-fulcrum plate 36, the feed slide member 42, and the feed arm attachment member 47 which are directly coupled to reciprocal movement of the feed arm 80 without using interposed plural links, it is easy to calculate the amount of the feed stroke of the feed arm 80. Even when the kind of the lead frame is changed, therefore, the adjustment of the feed stroke can be conducted very easily. Consequently, the machine has very excellent operability and workability.

Since the number of parts linked with the rocking arm 30 is small, the maintenance is easily performed and the production cost can be lowered.

When a lead frame is erroneously set, the opening and closing cylinder 59 is manually operated so as to open or close the toggle links 68 and 69, so that the feed plate 24 can be vertically moved. Consequently, the lead frame can be detached and the positional misalignment can be easily corrected, thereby improving workability and operability.

The invention is not restricted to the embodiment described above. The electric press machine may have plural punches and dies in place of the single combination of the punch and the die. The press die is not restricted to a press die for the D/D and may be a press die for the T/F (Trimming and Forming). It is a matter of course that various modifications may be made without departing from the spirit and the scope of the invention. For example, the press machine is not restricted to a machine for punch working, and the invention may be applied to a press machine which can perform another kind of press working, such as bend working.

Figure 13:
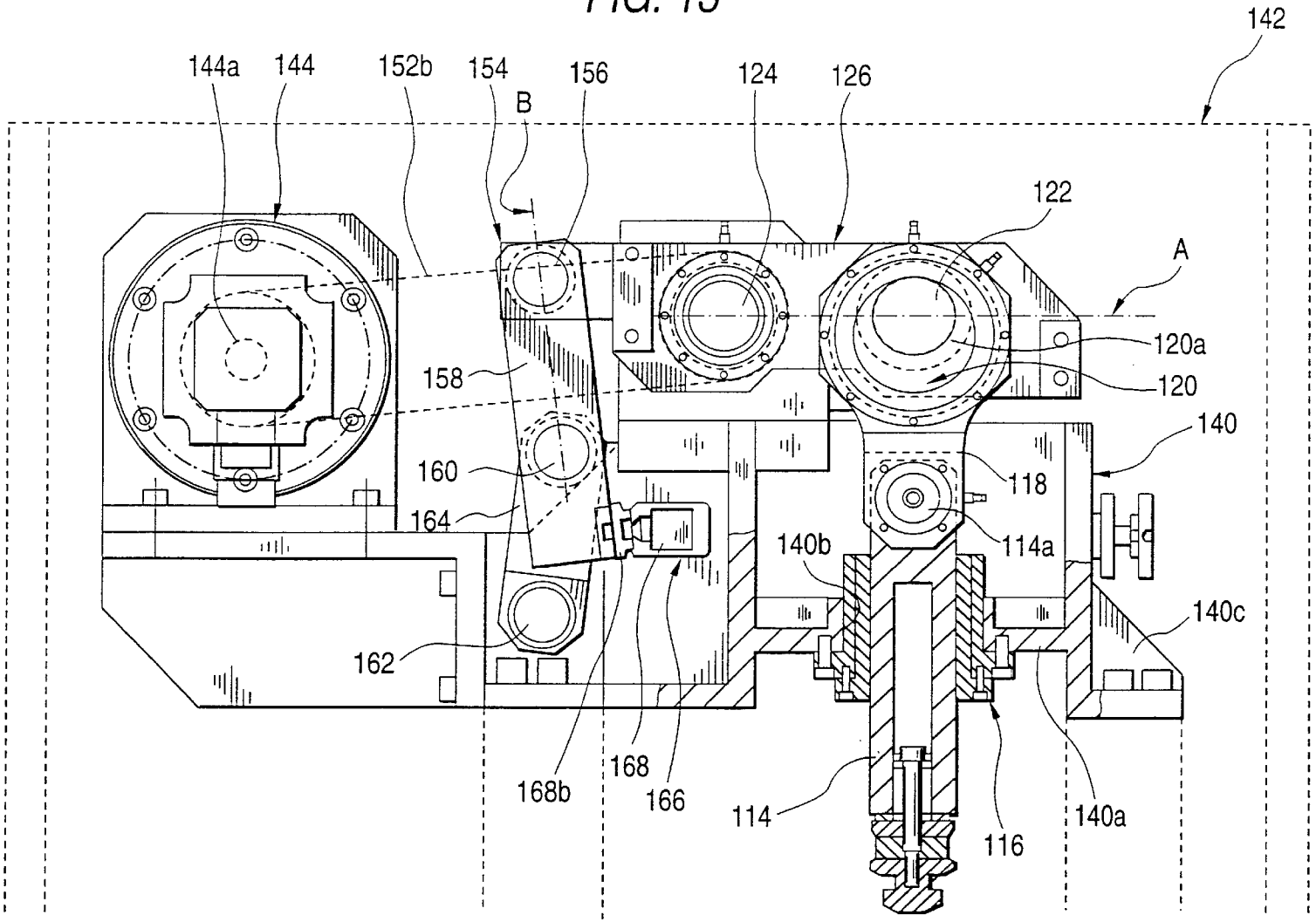
FIG. 13 is an explanatory diagram showing the configuration of various portions of a motor-operated press machine in a working state with a usual stroke.
Figure 14:
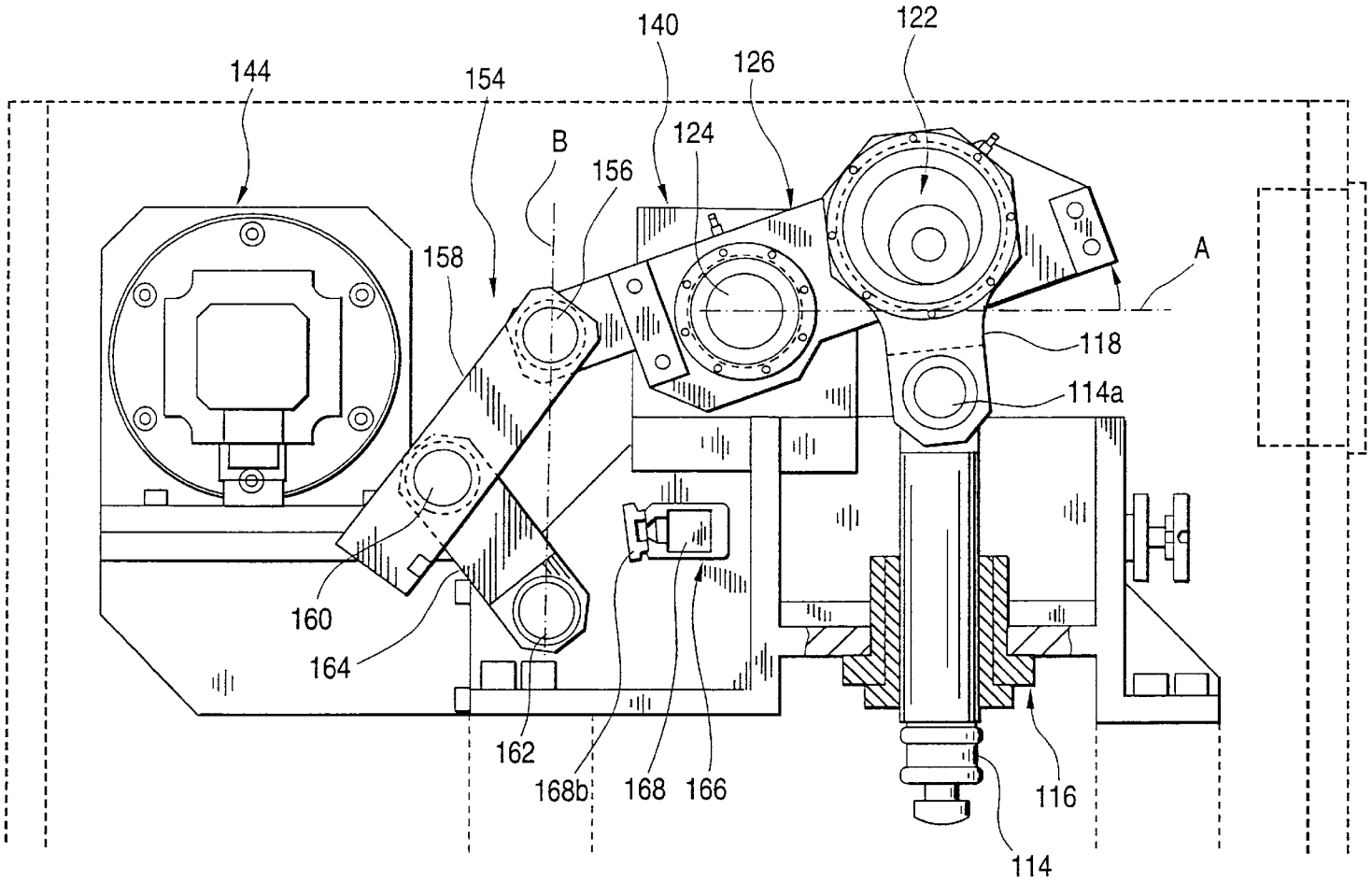
FIG. 14 is an explanatory diagram showing the configuration of various portions of the motor-operated press machine in a state where a press ram is moved to a retracting position of a higher level.
Figure 15:
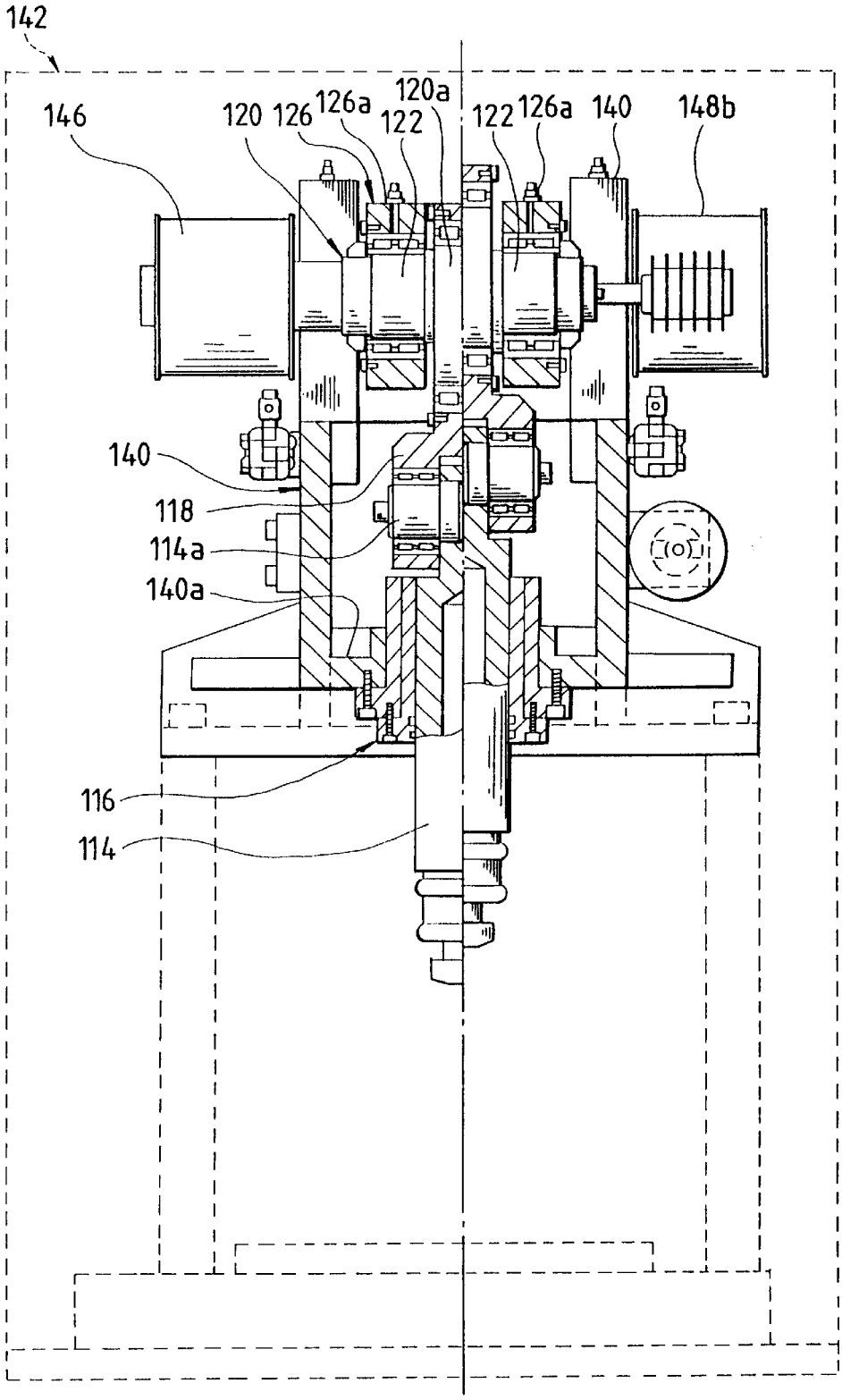
FIG. 15 is an explanatory diagram as seen from the front side and showing the operation of the press ram in a working state with a usual stroke.

FIGS. 13 to 15 are explanatory diagrams showing the configuration and operation of main portions of another motor-operated press machine of the invention. In the figures, 140 designates a support table of the motor-operated press machine, and 142 designates a casing which houses the motor-operated press machine. The press ram 114 is guided by a cylindrical slide guide 116 which is attached to a through hole 140*b* formed in a bottom face 140*a* of the support table 140, so as to downward elongate from the lower face of the support table 140. A bush impregnated with oil is mounted to a portion of the slide guide 116 which is to be contacted with the press ram 114, thereby enabling the press ram 114 to be smoothly moved.

Figure 17:
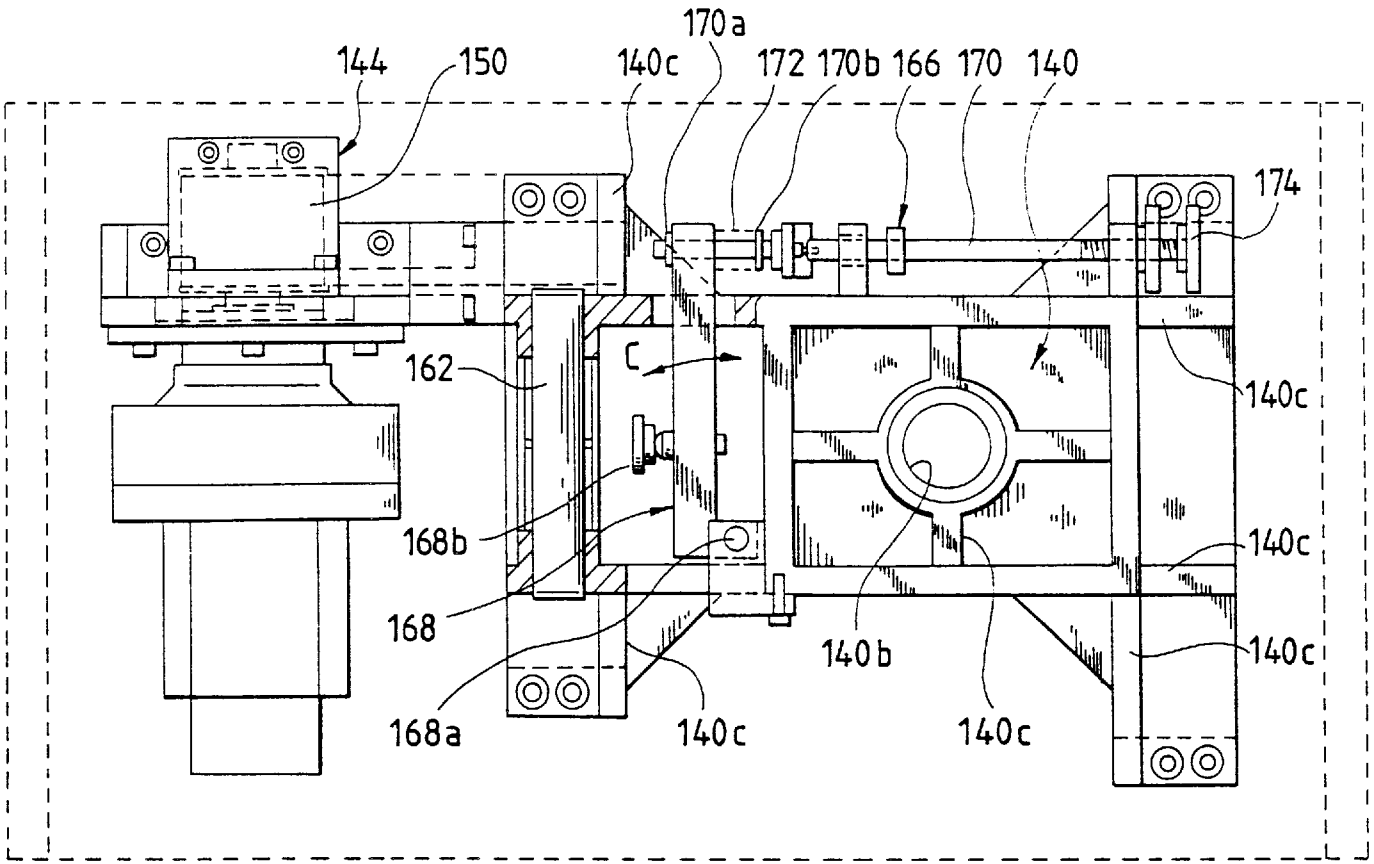
FIG. 17 is an explanatory diagram illustrating a stopper mechanism and showing the plan arrangement in which a rocking link is removed away.

As shown FIGS. 13 and 17, a plurality of ribs 140*c* are formed on the bottom face 140*a* of the support table 140 to which the slide guide 116 is attached, so as to reinforce the table. According to this configuration, unlike the prior art, sufficient strength is ensured even when the top plate 110 is not made thick.

The connecting rod 118 couples the press ram 114 to the crank 120. Both the ends of the connecting rod 118 are pivotally supported on a shaft 114*a* disposed in an upper portion of the press ram 114, and the eccentric shaft 120*a* of the crank 120, respectively, so as to convert the rotary motion of the crank 120 into the vertical motion of the press ram 114. The vertical stroke of the press ram 114 is regulated by the rotation stroke range of the eccentric shaft 120*a*.

The crank shaft 122 of the crank 120 is rotatably attached to the one end portion (the right end in FIG. 13) of the rocking link 126, and linked to an output shaft 144*a* of an electric motor 144 so as to be rotated.

In the prior art, as such an electric motor, a conventional electric motor (an induction motor or the like) is used. In the embodiment, a servomotor (a DC servomotor, an AC servomotor, or the like) is used as the electric motor 144. The use of a servomotor enables the rotation of the electric motor to be instantaneously stopped, even when a brake mechanism for stooping the rotation and required in the prior art is not disposed. Therefore, the mechanism can be simplified.

In the case where two motor-operated press machines are juxtaposed or a two-head press machine having two press mechanisms is employed, when an electric motor such as that used in the prior art is used, the operation timings of the two press mechanisms and a mechanism of feeding a workpiece are detected by sensors or the like, and the mechanisms are operated while they are synchronized with each other. Consequently, it is difficult to operate the mechanisms as a whole at a high speed. By contrast, the use of a servomotor allows the press mechanisms to be operated with predetermined operation timings, and the feeding mechanism to be operated in accordance with the operation of the press mechanisms and with predetermined operation timings. Therefore, it is not required to operate one mechanism while observing the operation of another mechanism, with the result that the operation speed of the whole of the machine can be enhanced.

The supporting shaft 124 is disposed above the support table 140 so as to horizontally elongate. A middle portion of the rocking link 126 is rotatably attached to the support table 140 by the supporting shaft 124, so that the rocking link 126 is rockable about the supporting shaft 124. In place of an L-like shape used in the prior art, the rocking link 126 is formed into a linear outer shape in which the crank shaft 122, the supporting shaft 124, and a first shaft which will be described later are arranged so as to be substantially on a straight line. The rocking link is attached so as to elongate in a lateral direction with respect to the vertical direction along which the press ram 14 is reciprocated. In the state of a press working operation and shown in FIG. 13, the crank shaft 122 and the supporting shaft 124 are on a first straight line A which is substantially horizontal.

Unlike the prior art example in which the rocking link 26 stands above the press ram 114, the rocking link 126 in the embodiment is disposed above the rocking link 126 so as to laterally elongate or lie in a lateral direction. Therefore, the total height of the motor-operated press machine can be made minimum.

The positional relationship between the crank shaft 122 and the press ram 114 will be described. When the rocking link 126 is rocked about the supporting shaft 124, the locus of the crank shaft 122 traces an arc. An extension of the center line of the press ram 114 is in contact with the arc.

FIG. 15 is a section view of the rocking link 126 and the crank shaft 122 as seen from the front side (the right side in FIG. 13).

Figure 18:
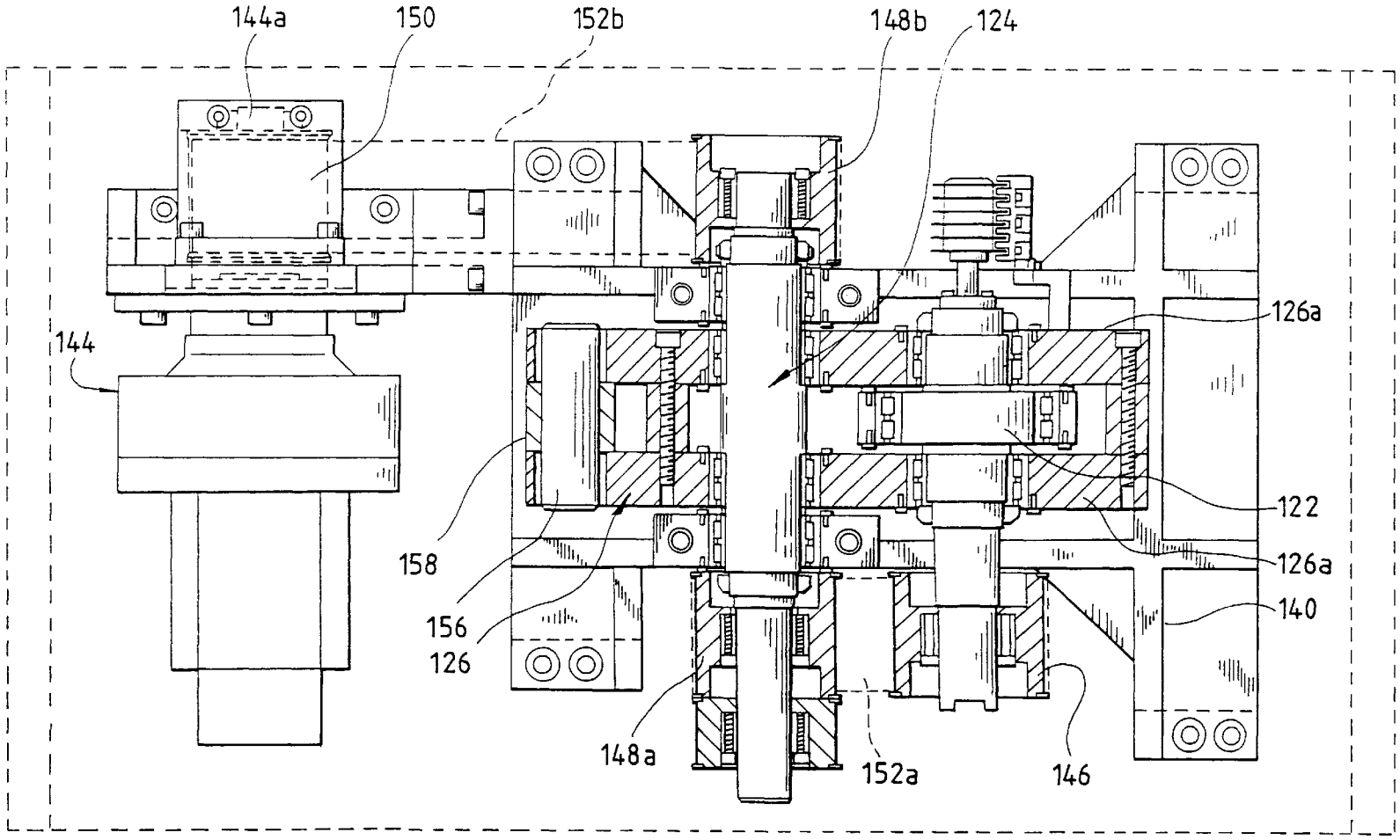
FIG. 18 is an explanatory diagram showing the plan arrangement of a crank, a supporting shaft, and a first shaft which are attached to the rocking link.

As shown in FIG. 18, the rocking link 126 is configured by integrally coupling a pair of supporting arms 126*a* with forming a gap therebetween. The crank 120 is sandwiched between the pair of supporting arms 126*a* . The crank shaft 122 projecting from the side faces of the crank 120 is rotatably supported on the supporting arms 126*a*. The eccentric shaft 120*a* formed at the middle of the crank 120 is rotatably passed through the upper end of the connecting rod 118, and the upper end of the press ram 114 is rotatably attached to the lower end by the shaft 114*a*.

A first pulley 146 for transmitting the torque to the crank 120 is disposed on the outer face of the one supporting arm 126*a* of the rocking link 126, and coupled to the crank shaft 122.

Hereinafter, an outline of a driving system for vertically moving the press ram 114 will be described. As shown in FIG. 18, second pulleys 148*a* and 148*b* are coupled to both the ends of the supporting shaft 124 which is horizontally disposed above the support table 140, respectively. The electric motor 144 is disposed in the side which is opposite to the side of the crank 120 with respect to the supporting shaft 124. A third pulley 150 is coupled to the output shaft 144*a* of the motor. Belts 152*a* and 152*b* are looped around the first pulley 146 and the second pulley 148*a,* and the second pulley 148*b* and the third pulley 150, respectively, whereby the driving force of the electric motor 144 is transmitted to the first pulley 146 so that the crank 120 is rotated. The rotation of the crank 120 causes the press ram 114 to be vertically moved.

A driving unit 154 is coupled to a tip end portion of the other end side (the left end side) of the rocking link 126 which is substantially horizontally laid in FIG. 13. The driving unit 154 causes the rocking link 126 to rock about the supporting shaft 124, thereby vertically moving the press ram 114.

The driving unit 154 has a function of, in a usual press working operation, regulating the position of the rocking link 126 so that the supporting shaft 124 is on the first straight line A which laterally elongates from the crank shaft 122 with respect to the moving direction of the press ram 114, and, in a resetting operation after jamming or an emergency during a working operation, lowering the other end portion of the rocking link 126 to rotate the rocking link 126 in a counterclockwise direction, thereby upward moving the press ram 114 to a retracting position above a position where the press ram is located in the usual press working operation.

The configuration of the driving unit 154 will be described in detail.

In the same manner as the prior art example, the driving unit 154 may be composed of the air cylinder 130, and the driving rod 132 of the air cylinder may be directly coupled to the other end portion of the rocking link 126 so as to rock the rocking link 126. In the embodiment, in place of the configuration in which the rocking link 126 is directly rocked by the air cylinder 130, a configuration in which the rocking link 26 is rocked via two links as shown in FIG. 13 is employed.

Specifically, the driving unit 154 comprises: a first link member 158 which is rotatably coupled at an upper end portion to the other end portion of the rocking link 126, by the first shaft 156; a second link member 164 which is rotatably coupled at the upper end portion to a lower end portion of the first link member 158, by a second shaft 160, and which is rotatably coupled at the lower end portion to a predetermined portion of the support table 140 below the other end portion of the rocking link 126, by a third shaft 162; and rotating means (for example, the air cylinder 130) for rotating the second link member 164 about the third shaft 162.

The driving unit further comprises a stopper mechanism 166 which is disposed on the support table 140, and which abuts against the first or second link member 158 or 164 to restrict the rotation of the second link member 164 in a direction toward the press ram 114. In the embodiment, for example, the stopper mechanism 166 abuts against the lower end of the first link member 158. Alternatively, the stopper mechanism 166 may abut against the upper end of the second link member 164.

As shown in FIG. 17, one end of the air cylinder 130 is rotatably attached to the support table 140 by the shaft 134. The tip end of the driving rod 132 is rotatably coupled to the second shaft 160.

Figure 16:
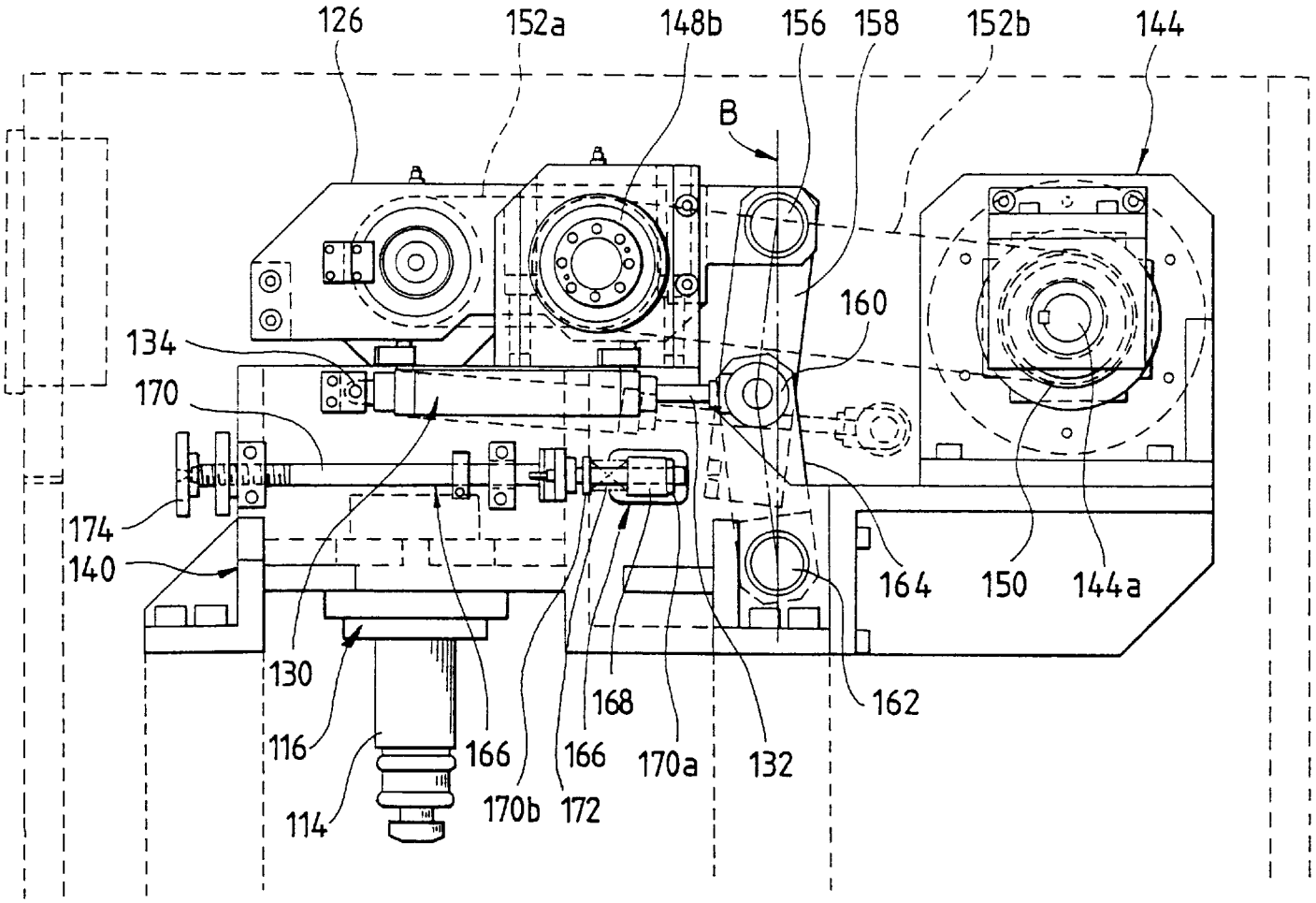
FIG. 16 is an explanatory diagram as seen from the rear side in FIG. 13.

In a press working operation, the driving rod 132 of the air cylinder 130 contracts so that the second link member 164 is rotated toward the press ram 114, thereby moving the second shaft 160 toward the press ram 114 beyond a second straight line B connecting the first and third lines 156 and 162. In this case, the lower end of the first link member 158 abuts against the stopper mechanism 166, thereby restricting the rotation of the second link member 164. Thereafter, the air cylinder 130 remains to urge the second link member 164 in the same direction. At this time, as shown in FIGS. 13 and 16, the first and second link members 158 and 164 are bent in an L-like shape which is directed toward the press ram 114. Even when a repulsion force acting on the press ram 114 in a press working operation is applied to the first and second link members 158 and 164 via the rocking link 126, therefore, the action direction of the force is always coincident with the direction along which the second link member 164 is rotated toward the press ram 114, and hence the first link member 158 surely receives a movement force in a direction along which the member abuts against the stopper mechanism 166. Consequently, the rocking link 126 is surely prevented from being rotated in a counterclockwise direction.

The stopper mechanism 166 has the above-described function of, in a press working operation, surely holding the rocking link 126 in a lateral state, and another function that the restriction position of the rocking link 126 and determined by the stopper mechanism 166 is slightly changed by changing the abutting position with respect to the first link member 158, so as to adjust the bottom dead center of the press ram 114.

In the embodiment, the stopper mechanism 166 has a further function that, when the force applied from the abutting first or second link member 158 or 164 exceeds a preset level (preset value), the rotation of the second link member 164 toward the press ram is enabled.

Because of this function, even when jamming or the like due to a failure in an operation of feeding a workpiece occurs and a force which is larger than the preset value is applied to the press ram 114, the second link member 164 the rotation of which has bee restricted is further rotated, and the force can be absorbed. Therefore, the dies and the pressing machine can be prevented from being damaged.

The configuration of the stopper mechanism 166 will be specifically described with reference to FIGS. 16 and 17.

A stopper body 68 directly abuts against the first link member 158 (or the second link member 164). For example, the appearance of the stopper body 168 is formed into a rod-like shape, the one end (the lower end in FIG. 17) is pivotally supported on a wall face of the support table 140 by a shaft 168*a* so that the stopper body is rotatable in a horizontal plane. An abutting section 168*b* which is to abut against one side face of the first or second link member 158 or 164 is disposed on the side face on the side of the first link member 158 (the second link member 164). When the stopper body 168 is rotated, the abutting section 168*b* disposed on the side face is arcuately moved along the moving direction (the direction of the arrow C in FIG. 17) of the second shaft 160.

A restricting member 170 abuts against the stopper body 168 to restrict the movement of the stopper body 168 toward the second shaft 160. For example, the restricting member is formed into a rod-like shape, one end (the left end in FIG. 16, the right end in FIG. 17) is screw fastened to the support table 140, and the other end (the right end in FIG. 16, the left end in FIG. 17) is attached to the support table 140 so as to pass through the freely rotatable end portion of the stopper body 168. The restricting member 170 is disposed so as to elongate in the longitudinal direction of the rocking link 126.

A first large-diameter portion 170*a* is formed at the other end of the restricting member 170 which passes through the stopper body 168 so as to protrude therefrom. A second large-diameter portion 170*b* is formed at a position which is separated from the first large-diameter portion 170*a* across the stopper body 168. Therefore, the free end portion of the stopper body 168 is movable between the first and second large-diameter portions 170*a* and 170*b*.

A coil spring 172 is insertedly attached between the free end portion of the stopper body 168 and the second large-diameter portion 170*b*, in such a manner that the coil spring is fitted onto the restricting member 170. The coil spring serves as an urging member which always urges the stopper body 168 in a direction in which the stopper body 168 is separated from the press ram 114 with respect to the second large-diameter portion 170*b*. The urging force of the coil spring 172 can be arbitrarily set in accordance with the diameter and material of the wire member, and the degree of the fastening exerted in the insertion. In place of the coil spring 172, a helical spring, a plate spring, or the like may be used.

Since the one end of the restricting member 170 is screw fastened to the support table 140, the position of the first large-diameter portion 170*a* in the longitudinal direction of the restricting member 170 can be changed by rotating the restricting member 170. Therefore, also the position of the stopper body 168 which is always urged by the coil spring 172 so as to abut against the first large-diameter portion 170*a* can be changed, so that the restriction position of the stopper body 168 and determined by the stopper mechanism 166 is changed. Therefore, the bottom dead center of the press ram 114 can be adjusted.

In the stopper mechanism 166 of the embodiment, when a force which exceeds the urging force of the coil spring 172 is applied from the first or second link member 158 or 164 which abuts against the stopper body 168, the coil spring 172 contracts so as to allow the second link member 164 to be rotated toward the press ram 114. In consideration of the strength of the dies driven by the press ram 114, and that of the rocking link 126, the first and second link members 158 and 64, and the like which constitute the motor-operated press machine, therefore, the urging force of the coil spring 172 is previously set to a preset value. As a result, even when jamming or the like due to a failure in an operation of feeding a workpiece occurs during a pressing work and a large force greater than the preset value is applied to the press ram 114, the second link member 164 the rotation of which has been restricted is further rotated so that the force is absorbed, whereby the dies and the pressing machine can be prevented from being damaged.

The reference numeral 174 designates an adjusting knob which attached to one end of the restricting member 170. The restricting member 170 is reciprocally moved in the longitudinal direction thereof by manually rotating the adjusting knob 174. The rotation of the restricting member 170 may be performed by an electric motor or the like, in place of a manual operation. A load cell may be disposed in the press ram 114 so as to detect a pressure applied to the press ram 114, and the electric motor may be driven in accordance with the detected pressure, thereby enabling the adjustment of the bottom dead center of the press ram 114 to be automatically performed.

The embodiment is configured so that the lower end portion of the first link member 158 is downward elongated beyond the second shaft 160, and the stopper mechanism 166 abuts against a portion of the first link member 158 which is below the second shaft 160 of the first link member 158. According to the principle of the lever, therefore, the rotation of the second link member 164 can be restricted so as to prevent the rocking link 126 from being rotated, by a smaller force than that in the case where the stopper mechanism 166 abuts directly against the vicinity of the second shaft 160. Consequently, the coil spring 172 can be made small in size, and the stopper mechanism 166 and hence the whole of the pressing machine can be miniaturized. In place of this configuration, alternatively, the upper end portion of the second link member 164 may be upward elongated beyond the second shaft 160, and the stopper mechanism 166 may abut against a portion of the second link member 164 which is above the second shaft 160. In the alternative, the same effects can be attained.

FIG. 13 and FIG. 16 (a view as seen from the side opposite to that of FIG. 13) show a state where the rocking link 126 is at a lower position and the usual press working operation is conducted by using the press ram 114. FIG. 15 shows the manner of vertically moving the press ram 114. Specifically, the left half with respect to the center line shows a state where the press ram 114 is lowered, and the right half a state where the press ram 114 is raised. The press ram 114 is vertically moved by rotating the crank 120 via the driving system by the motor 144.

FIG. 14 shows another use state of the motor-operated press machine, or a state where the press ram 114 is further moved above the range of stroke in a usual work. This movement of the press ram 114 to the upper position is conducted in the following cases: the case where a trouble occurs in a usual work and the press working operation must be immediately stopped, and that where, in a resetting operation after jamming, the press ram 114 is moved to a position where the work is not obstructed.

When a trouble such as that a workpiece is erroneously fed to damage the die occurs during press working, for example, the machine of the embodiment can operate in the following manner: the air cylinder 130 is immediately operated so that the rocking link 126 is rotated in a counterclockwise direction, and the press ram 114 is upward moved to a position above that where the press ram is located in the usual press working operation, thereby allowing the press ram 114 to be moved to a retracting position. The press ram 114 has inertia of a certain level. When the press ram is forcedly moved so as to be separated from the working position as in the case of the embodiment, however, the press ram can be instantaneously retracted in an adequate manner against the inertia.

A machine such as that of the embodiment in which the press ram 114 is upward moved above a usual working position has an advantage that a work such as a resetting operation after jamming can be easily conducted. In the machine of the embodiment, particularly, an operation of setting the press ram 114 to the retracting position which is high in level can be easily conducted by the rotating operation of the rocking link 126 by means of the air cylinder 130. The movement of the press ram 114 can be immediately conducted. Therefore, the machine is easy to operate. Furthermore, the machine has a feature that, after a work, the press ram 114 can be set easily and quickly to a position of a usual working state.

When the press ram 114 is to be moved above the position of a usual working state, the driving rod 132 of the air cylinder 130 is projected (projected to the position indicated by broken lines in FIG. 16), the second link member 164 is rotated in a direction opposite to the press ram 114, and the second shaft 160 is moved beyond the second straight line B to the side opposite to the press ram 114. In this case, when the second link member 164 is rotated by a predetermined angle or more, the other end portion of the rocking link 126 is lowered via the first link member 158, and hence the one end portion of the rocking link 126 is upward moved. This causes the press ram 114 to be upward moved to the retracting position above the position where the press ram is located in the usual press working operation.

In the embodiment, as described above, an extension of the center line of the press ram 114 is in contact with the arc along which the crank shaft 122 is moved when the rocking link 126 is rocked about the supporting shaft 124. In a resetting operation or the like, therefore, the press ram 114 can be raised in a substantially vertical direction by rotating the rocking link 126 so as to be moved to the retracting position. Therefore, the resistance between the press ram and the slide guide 116 is lower than that in the configuration of the prior art in which the press ram 114 is raised from a lateral side, and hence the upward movement can be efficiently conducted. As a result, the air cylinder 130 of the driving unit 154 can be made smaller than that of the prior art example, and the press machine can be miniaturized.

The operation of rotating the rocking link 126 may be conducted after the rotation of the crank in a press working operation is stopped, or alternatively may be conducted without stopping the rotation of the crank.

According to the invention, as described above, the upper die is vertically moved by the electric motor to conduct press working, and the operation of feeding a lead frame is conducted while the operation of feeding the lead frame and the vertical movement of the feed plate are synchronized with each other via the drive transmitting mechanism. Therefore, the index time required for the operation of feeding a lead frame and press working can be remarkably shortened and the working efficiency can be enhanced.

Particularly, the configuration in which the drive transmitting mechanism which transmits the driving to the feeding mechanism and the feed plate vertically moving mechanism is provided with the feed cam and the raising cam attached to the cam shaft, and a cam curve is formed so that, at the start of and before the stop of the feeding operation of a lead frame, a low speed is attained, and, during the feeding operation, a high speed is attained enables the lead frame to be fed without being damaged, and breakage of the feed pin of the feed arm to be reduced.

Furthermore, the distance between the rock center of the rocking arm and the linked position of the movable body is changed in the longitudinal direction of the rocking arm by driving the movable fulcrum moving means, whereby the feed stroke of the feed arm can be linearly changed.

Particularly, because rocking movement of the rocking arm is converted into linear movement of the movable body which is directly coupled to reciprocal movement of the feed arm, without using interposed plural links, it is easy to calculate the amount of the feed stroke of the feed arm. Even when the kind of the lead frame is changed, the adjustment of the feed stroke can be conducted very easily. Consequently, the machine has very excellent operability and workability.

Since the number of parts linked with the rocking arm is small, the maintenance is easily performed and the production cost can be lowered.

When a lead frame is erroneously set, the opening and closing cylinder is manually operated so as to open or close the toggle link mechanism, and the feed plate can be vertically moved. Consequently, the lead frame can be detached and the positional misalignment can be easily corrected, thereby improving workability and operability.

According to the motor-operated press machine of the invention, an efficient press working operation with a usual stroke, and a die opening operation in a resetting operation after jamming can be easily conducted, and the disposition of the rocking link at a lateral position with respect to the press ram which is vertically reciprocated enables the total height of the motor-operated press machine to be reduced as compared with a configuration of the prior art in which a rocking link is vertically disposed above a press ram.

In a resetting operation after jamming or the like, moreover, the press ram can be raised in a substantially vertical direction by rotating the rocking link so as to be moved to the retracting position. Therefore, the upward movement can be conducted more efficiently than that in the configuration of the prior art in which the press ram is raised from a lateral side. As a result, the driving unit can be made small, and the whole of the press machine can be miniaturized.

When the stopper mechanism receives a force of a degree larger than a preset degree from the first or second link member abutting thereagainst, the stopper mechanism enables the second link member to rotate in the direction toward the press ram. Therefore, the invention attains an excellent effect that, even when jamming or the like due to a failure in an operation of feeding a workpiece occurs during a pressing work and a large force is applied to the press ram, the stopper can absorb the force, so that dies and the pressing machine can be prevented from being damaged.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electric press machine which conducts press working on a lead frame in which pilot holes are formed while the lead frame is pitch fed to a press section having a press die, said electric press machine comprising:

a feed arm having pins which are engageable with the pilot holes of the lead frame;

a feeding mechanism which reciprocates said feed arm in a direction of transporting the lead frame;

a feed plate which, in said press section, guides and supports the lead frame in a movable manner in the transporting direction, and which is disposed so as to be vertically movable;

a feed plate vertically moving mechanism which vertically moves said feed plate;

a drive transmitting mechanism which drives said press section, and which rotates a feed cam and a raising cam to transmit driving to said feeding mechanism and said feed plate vertically moving mechanism, said feed cam and said raising cam being disposed on a cam shaft; and an electric motor which operates said drive transmitting mechanism;

wherein in said feeding mechanism, a movable body is linked with a rocking arm which is pressingly contacted via a movable fulcrum with said feed cam and which rocks about a stationary fulcrum, rocking movement of said rocking arm is converted into linear movement of said movable body which is directly coupled to reciprocal movement of said feed arm, and a distance between said stationary fulcrum of said rocking arm and said movable fulcrum is changed in a longitudinal direction of said rocking arm, thereby enabling a feed stroke of said feed arm to be linearly changed.

2. An electric press machine according to claim 1, wherein, when said electric motor is started, said drive transmitting mechanism reciprocates said press die, and rotates said cam and said raising cam which are disposed on the same cam shaft, to alternatingly conduct forward movement or backward movement of said feed arm, and upward movement or downward movement of said feed plate, thereby pitch feeding the lead frame.

3. An electric press machine according to claim 1, wherein, in said feeding mechanism, said movable fulcrum is movably linked with a guide groove which is formed in the longitudinal direction of said rocking arm, and, in accordance with rocking movement of said rocking arm, a position of said movable fulcrum is reciprocated along said guide groove, thereby converting rocking movement of said rocking arm into linear movement of said movable body.

4. An electric press machine according to claim 3, wherein said machine further comprises movable fulcrum moving means for changing a distance between the stationary fulcrum of said rocking arm and a linked position of said movable fulcrum, and said movable fulcrum moving means is driven to change the linked position of said movable fulcrum along said guide groove which is formed in the longitudinal direction of said rocking arm.

5. An electric press machine according to claim 1, wherein said feed plate vertically moving mechanism vertically moves said feed plate via a toggle link mechanism which is opened and closed in linkage with a vertically moving lever which is rotated with being pressingly contacted with said raising cam.

6. An electric press machine according to claim 5, wherein said toggle link mechanism is configured so that, in an abnormal condition, an opening and closing cylinder is operated to enable a toggle link to be opened or closed.

7. An electric press machine according to claim 6, wherein a support plate which supports said toggle link mechanism is supported by a coil spring, and said coil spring absorbs a pressing force which is exerted when said feed plate is once downward moved and then further pressingly downward moved by downward movement of said upper die.

8. A motor-operated press machine comprising:

a support table;

a rocking link which is attached at a middle portion to said support table by a supporting shaft, and which is rockable about said supporting shaft;

a crank in which a crank shaft serving as a support shaft is rotatably supported on one end portion of said rocking link;

a press ram which is linked to said crank and which is vertically reciprocated by rotating said crank; and a driving unit which is coupled to another end portion of said rocking link to rock said rocking link about said supporting shaft, thereby vertically moving said press ram;

wherein said driving unit, in a usual press working operation, regulates said rocking link to a lateral position with respect to a position above said press ram so that said supporting shaft is on a first straight line which laterally elongates from said crank shaft with respect to a moving direction of said press ram, and, in a resetting operation after jamming or an emergency during a working operation, lowers said other end portion of said rocking link to upward move said press ram to a retracting position above a position where said press ram is located in the usual press working operation.

9. A motor-operated press machine according to claim 8, wherein said driving unit comprises:

a first link member which is rotatably coupled at an upper end portion to said other end portion of said rocking link, by a first shaft;

a second link member which is rotatably coupled at said upper end portion to a lower end portion of said first link member, by a second shaft, and which is rotatably coupled at said lower end portion to a predetermined portion of said support table below said other end portion of said rocking link, by a third shaft;

rotating means for rotating said second link member about said third shaft; and a stopper mechanism which is disposed on said support table, and which abuts against said first or second link member to restrict rotation of said second link member in a direction toward said press ram; and wherein said rotating means, in the press working operation, rotates said second link member in the direction toward said press ram, thereby causing said first or second link member to abut against said stopper mechanism under a state where said second shaft is moved toward said press ram beyond a second straight line connecting said first shaft and said third shaft, and, in the resetting operation, an emergency, or the like, rotates said second link member in a direction opposite to said press ram to move said second shaft in a direction opposite to said press ram with respect to said second straight line, thereby lowering said other end portion of said rocking link.

10. A motor-operated press machine according to claim 9, wherein said stopper mechanism abuts against a portion of said first link member which is lower in level than said second shaft, or a portion of said second link member which is higher in level than said second shaft.

11. A motor-operated press machine according to claim 9, wherein, when said stopper mechanism receives a force of a degree larger than a preset degree from said first or second link member abutting against said stopper mechanism, said stopper mechanism enables said second link member to rotate in the direction toward said press ram.

12. A motor-operated press machine according to claim 9, wherein said stopper comprises:

a stopper body which is movable along a moving direction of said second shaft;

an urging member which always urges said stopper body in a direction in which said stopper body is separated from said press ram; and a restricting member which abuts against said stopper body to restrict a movement of said stopper body toward said second shaft.

13. A motor-operated press machine according to claim 12, wherein said stopper is provided with an adjusting mechanism which adjusts a restriction position of said stopper body and determined by said restricting member to adjust a rotation amount of said first or second link member in the direction toward said press ram, thereby finely adjusting a bottom dead center of said press ram in the press working operation.

* * * * *